US007214464B2

(12) United States Patent
Roberts et al.

(10) Patent No.: US 7,214,464 B2
(45) **Date of Patent: *May 8, 2007**

(54) HIGH SPEED POSITIVE-WORKING PHOTOTHERMOGRAPHIC RADIOGRAPHIC FILM

(75) Inventors: Michael R. Roberts, Rochester, NY (US); Kurt D. Sieber, Rochester, NY (US); Paul B. Gilman, Jr., Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/834,581

(22) Filed: Apr. 29, 2004

(65) Prior Publication Data

US 2005/0244760 A1 Nov. 3, 2005

(51) Int. Cl.
*G03C 5/16* (2006.01)
*G03C 7/32* (2006.01)

(52) U.S. Cl. ..... 430/139; 430/21; 430/350; 430/373; 430/378; 430/544; 430/547; 430/552; 430/566; 430/619; 430/620

(58) Field of Classification Search ..... 430/619, 430/139, 566, 350, 21, 378, 373, 620, 544, 430/547, 552
See application file for complete search history.

(56) References Cited

U.S. PATENT DOCUMENTS 4,186,009 A * 1/1980 Jones ..... 430/353
4,480,024 A * 10/1984 Lyons et al. ..... 430/139
2002/0015928 A1* 2/2002 Irving et al. ..... 430/620
2002/0102502 A1* 8/2002 Fukui et al. ..... 430/350
2004/0033447 A1 2/2004 Zou et al.

FOREIGN PATENT DOCUMENTS

GB 1507829 * 4/1978

OTHER PUBLICATIONS

U.S. Appl. No. 10/460,129, filed Jun. 12, 2003, Roberts et al.

* cited by examiner

*Primary Examiner*—Thorl Chea
(74) *Attorney, Agent, or Firm*—Chris P. Konkol

(57) ABSTRACT

The present invention is directed to a method of forming a positive image in a photothermographic assembly comprising a photothermographic material and an intensifying means for converting ionizing radiation, wherein the assembly has been imagewise exposed to ionizing radiation to form a latent image in the photothermographic material. The photothermographic material has at least one imaging layer comprising a potentially negative-working emulsion, wherein thermal development of unexposed silver salts in exposed areas relative to unexposed areas is inhibiting when thermally developing the imagewise exposed assembly, thereby producing a positive image. The present invention is also directed to a photothermographic assembly that can be used in the present process in which a positive image characterized by high speed and discrimination is formed when exposed and thermally heated above 150° C.

20 Claims, 1 Drawing Sheet

HIGH SPEED POSITIVE-WORKING PHOTOTHERMOGRAPHIC RADIOGRAPHIC FILM

FIELD OF THE INVENTION

This invention relates to a high-speed positive-working silver-halide photothermographic element for medical and industrial radiography, and a process of making an image employing such element.

BACKGROUND OF THE INVENTION

In conventional radiography, films containing light-sensitive silver-halide grains are employed in a number of image recording devices including but not limited to x-ray imaging cassettes, film based dosimeters and intra-oral dental film packets. Upon exposure, the film produces a latent image that is only revealed after suitable processing. These film elements have historically been processed by treating the exposed film with at least a developing solution having a developing agent that acts to form an image in cooperation with other components in the film.

It is always desirable to limit the amount of solvent or processing chemicals used in the processing of silver-halide films. The traditional photographic processing scheme for black-and-white film involves development, fixing and washing, each step typically involving immersion in a tank holding the necessary chemical solution. By the use of photothermographic film, it is possible to eliminate processing solutions altogether, or alternatively, to minimize the amount of processing solutions and the complex chemicals contained therein. A photothermographic (PTG) film by definition is a film that requires energy, typically heat, to effectuate development. A dry photothermographic film requires only heat. A solution-minimized photothermographic film may require small amounts of aqueous alkaline solution to effectuate development, which amounts may only be that required to swell the film without excess solution. Development is the process whereby silver ion is reduced to metallic silver and in a color system, a dye is created in an image-wise fashion. In many photothermographic films, the silver is typically retained in the coating after the heat development.

In photothermographic films employing what is referred to as "dry physical development," a photosensitive catalyst is generally a photographic-type photosensitive silver halide that is considered to be in catalytic proximity to a non-photosensitive source of reducible silver ions. Catalytic proximity requires intimate physical association of these two components either prior to or during the thermal image development process so that when silver atoms, $(Ag^{o})_{n}$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms (Klosterboer, Neblette's Eighth Edition: *Imaging Processes and Materials*, Sturge, Walworth & Shepp (eds.), Van Nostrand-Reinhold, New York, Chapter 9, pages 279–291, 1989). It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029. *Research Disclosure* is a publication of Kenneth Mason Publications Ltd., Dudley House, 12 North Street, Emsworth, Hampshire PO10 7DQ England and also available from Emsworth Design Inc., 147 West 24th Street, New York, N.Y. 10011). *Research Disclosure*, September 1996, Number 389, Item 38957 is hereafter referred to as "*Research Disclosure I*".

The non-photo-sensitive source of reducible silver ions is typically a material that contains reducible silver ions and preferably a silver salt of an organic compound.

Photothermographic (PTG) media employing dry physical development are formulated with one or more light sensitive imaging layers on a light transmitting or reflecting support. Each imaging layer typically has at least one light-sensitive silver-halide emulsion, a reducible non-light-sensitive silver salt, a developer or developer precursor, and optionally a coupler to form dye. Other components may include accelerators, toners, binders, and antifoggants known in the trade as well as components used in conventional solution-processed silver-halide photographic media.

When exposed to light and then heated at temperatures ranging from 100 to 200° C. for 5 to 60 seconds, photothermographic media develop densities varying with exposure. The density versus log exposure curve (H&D curve) is commonly used in the trade to compare parameters such as speed and contrast. A typical procedure for generating the H&D curve entails making a contact exposure through a step tablet image. The steps modulate the intensity of the incident light, usually in 0.10 to 0.30 log exposure increments. Another method entails exposing pixel-wise using a laser, CRT or LED source in which the exposure intensity is modulated electronically. The H&D curve can also be determined using ionizing radiation such as x-radiation that is used in radiography. One method of determining the H&D curve with ionizing radiation is to vary the amount of ionizing radiation received by the photothermographic media by passing the ionizing radiation through an ionizing radiation absorbing step wedge before it impinges on the photothermographic element. Another method of determining the H&D curve with ionizing radiation is to perform successive exposures of the photothermographic element at different doses where the amount of ionizing radiation impinging on the photothermographic media for each exposure is determined by using an additional device (such as a dosimeter or radmeter) to measure the amount of ionizing radiation impinging on a surface for a given set of exposure conditions. In both methods the exposed media is processed after exposure then measured.

The measured reflection or transmission density of each step on the photographic media is then plotted against relative or absolute log exposure to produce what is known in the industry as the "H&D curve." H&D curves typically have two plateaus corresponding to the maximum density (Dmax) and minimum density (Dmin) where the slope of the H&D curve approaches or equals zero; that is, a change in exposure produces little or no change in measured density. Gamma refers to the slope of the H&D curve usually at some fixed density position. Point gamma refers to the change in density between two adjacent exposure positions in a plot of the H&D values. The mid-scale density refers to the density midway between Dmax and Dmin plateaus, or (Dmax–Dmin)/2. The corresponding exposure is designated the midscale exposure.

As used herein with respect to the present invention, the term "negative-working" refers to a photographic silver-halide emulsion that develops more density with increasing exposure up to the Dmax limit when an imagewise-exposed gelatin coating of the emulsion is processed using a solution-development process and concomitant materials in accordance with the well-known and conventional D-76 standard. The corresponding H&D curve has a positive slope in the mid-scale density range when density is plotted against increasing relative log exposure. The unexposed areas develop to Dmin. The image produced in this way is referred to as a "negative image." It is to be understood that the term "negative-working emulsion" as used herein is synonymous with "potentially negative-working emulsion" and refers to an inherent capability of the emulsion that may or may not be realized in practice. A "positive-working" photographic silver-halide emulsion, as used herein with respect to the present invention, responds to exposure by developing less density with increasing exposure down to the saturation limit (Dmin) when an imagewise-exposed gelatin coating of the emulsion is processed using a solution-development process and materials in accordance to the well-known D-76 standard. In this case, the H&D curve has a negative slope in the mid-scale density region when density is plotted against increasing relative log exposure. The unexposed areas develop to Dmax. The image produced in this way is referred to as a "positive image."

Materials, including solution developers, qualifying for commercially acceptable use in a D-76 standard process include Kodak's trademarked products designed for such a process. See G. Haist, "Modern Photographic Processing, Vol 1", John Wiley & Sons, Chapter 7, p 340 (1979) for the preparation of D-76 developer and other related developer formulas, the disclosure of which is hereby incorporated by reference. D-76 developer, therefore, includes any or all materials designated for and commercially used, with commercially satisfactory results in a D-76 process. Preferably, the D-76 developer is a Kodak product or one that is substantially equivalent in practice.

In a positive-working or negative-working emulsion, the developed density can comprise either silver, or if the imaging layer also contains a dye-forming coupler to react with oxidized developer, silver plus dye.

In the case of conventional solution-processed photographic media, as compared to dry or apparently dry thermally developed photothermographic media, positive images can be obtained from negative-working emulsions using combinations of multiple exposures and/or multiple development steps. See G. Haist, cited above, for details on black-and-white and color reversal-development processes, in which the following patents are cited: U.S. Pat. Nos. 2,005,837, 2,126,516, 2,184,013, 2,699,515, 3,361,564, 3,367,778, 3,455,235, 3,501,310, 3,519,428, 3,560,213, 3,579,345, 3,650,758, 3,655,390, BR 44248, BR 1151782, BR 1155404, BR 1186711, BR 1201792, CA 872180, and CA 872181.

For example, photobleach emulsions can be used in conventional solution-developed silver-halide photographic media to produce positive images. These emulsions are prepared with desensitizing dyes and chemical fogging agents. An exposure destroys preformed surface fog centers rendering the grains undevelopable. The unexposed grains develop to form a positive image. G. Haist reviews this topic in *Modern Photographic Processing*, Vol 2, Chapter 7, John Wiley & Sons, (copyright 1979).

GB 2018453A to Willis et al. teaches a photothermographic element comprising resorcinolic coupler, phenylenediamine developer, gelatin, silver bromoiodide emulsion (negative-working), various reducible organic silver salts (notably the silver salt of 3-amino-5-benzylthio-1,2,4-triazole (ABT)), and an antifoggant 3-methyl-5-mercapto-1,2,4-triazole (MMT). Slusarek et al., in U.S. Pat. No. 6,319,640 and U.S. Pat. No. 6,312,879, describes blocked phenylenediamine developers for photothermographic media coated from water and gelatin.

Negative-working photographic silver-halide emulsions are used in radiography for both industrial and medical applications. Negative-working photographic silver-halide emulsions can be used to image ionizing radiation directly or indirectly by the use of an intensifying element for ionizing radiation. An intensifying element is used for converting ionizing radiation to a lower-energy form suitable for exposing photographic or photothermographic elements. In radiography, intensifying elements are used in conjunction with photographic elements. Known intensifying elements include, for example, inorganic and organic phosphors as well as metal particles and metal foils. Intensifying elements in radiography can also be intensifying screens, imaging plates, radiographic screens, or phosphor screens. Most intensifying screens used in radiography contain luminescent materials called phosphors, scintillators, or luminophores. These materials, often in the form of particles, emit visible light upon irradiation with ionizing radiation. The light emitted by the phosphor leaves the intensifying element or screen and impinges on the negative-working photographic silver-halide emulsion to form the latent image that is subsequently developed imagewise.

Thus, radiographic films can be used in combination with some other material to convert the x radiation to another radiation form that can be more readily detected by silver halide in the films. Such radiation converting materials can be metal plates of metal oxides that convert x-radiation to electrons or can be inorganic phosphors that convert x-radiation to visible radiation. Such converting materials are usually provided in a separate element in what is known as "metal screens," intensifying screens, or phosphor panels. If phosphors or metal oxides are included within the typical silver halide emulsion, image noise levels may increase. This is due to the fact that electrons or visible radiation from the converting materials may expose silver halide grains outside of the image area, giving rise to image noise. Thus metal or phosphor intensifying screens or panels may be preferred for use in combination with radiographic films in what are known as cassettes or radiographic imaging assemblies. However, the incorporation of phosphors in silver-halide emulsions are known. U.S. Pat. No. 6,440,944 teaches the use of negative imaging photothermographic elements with intensifying screens as well as the direct addition of x-ray sensitive phosphors to the photothermographic element to prepare a radiographic element suitable for imaging.

Negative-working photothermographic silver-halide emulsions are used in medical imaging as image-receiving elements in laser printing stations such as the KODAK DryView® laser printer. These laser printer stations are used to obtain hard copy images, of results from physical examinations of patients, taken using digital imaging modalities such as magnetic resonance imaging, ultrasound, positron emission tomography, computer aided tomography, and computed radiography. The negative-working photothermographic silver-halide emulsions used in these systems is not exposed to ionizing radiation. An example of a negative-working photothermographic silver-halide emulsion that can be used to image ionizing radiation is described in U.S. Pat. No. 6,440,649 by Simpson et al.

Historically, photographic films containing various silver halides have been used for various radiographic purposes. Such films have exhibited excellent sensitivity to x-radiation, high spatial resolution, low image noise, and archival storage properties. Desired sensitivity to imaging x-radiation has been achieved through amplification of a relatively small number of latent image centers without too much noise being added to the image. The term noise is understood in radiography to refer to the random variations in optical density throughout a radiographic image that impairs the user's ability to distinguish objects within the image. Radiographic noise is considered to have a number of components identified in the art as quantum mottle, film grain, and structure mottle as noted, for example, by Ter-Pogossian, *THE PHYSICAL ASPECTS OF DIAGNOSTIC RADIOLOGY*, Harper and Row, New York, Chapter 7, 1967.

Positive-working photographic silver-halide emulsions are not generally used for imaging ionizing radiation or in radiography. There are no known positive-working photothermographic silver-halide emulsions that are sensitive to ionizing radiation.

A significant problem with photothermographic elements has been the difficulty obtaining high photographic speeds. Silver-halide emulsions that are optimally sensitized for photographic speed in aqueous gelatin generally lose speed in contact with organic solvents and non-gelatin binders that are used in many non-aqueous photothermographic systems. Organic solvents may induce dye desorption, dye deaggregation, or some other chemical effect that degrades photographic efficiency. Methods of chemical and spectral sensitizations in organic solvents are less effective than in water for similar reasons.

Gelatin coatings, on the other hand, are more difficult to thermally develop due to the physical properties of the gelatin when it is heated. Lower developed density and photographic speed generally result from the higher glass transition temperature of gelatin and generally slower rates of diffusion of developer components in the strong hydrogen bonding polypeptide matrix. Gelatin coatings also require dispersing the incorporated water-insoluble developer components, which causes them to react generally more sluggishly under thermal processing conditions compared to organic solvent coatings in which developer components are dissolved in the coating solvent.

In addition, all of the prior art describes photothermographic systems that produce negative images that are nearly equal in speed to those obtained with solution development. In contrast, the present invention can produce direct-positive photographic speeds that are two to three stops greater than speeds obtained by solution or thermal development of same-size negative-working silver-halide emulsions.

SUMMARY OF THE INVENTION

The present invention is directed to a method of using ionizing radiation to form an image in a positive-working photothermographic element or material, such as film, comprising a potentially negative-working emulsion but in which fog-density development in exposed areas of the image is imagewise inhibited upon thermal development. By "fog density" is meant the thermal development, in the emulsion, of unexposed silver particles, whether light-sensitive and/or non-light sensitive silver-containing particles. The image can be monochrome or bichrome. Without wishing to be bound by theory, it is believed that imagewise inhibition occurs by the presence of an inhibiting agent or precursor thereof, for example, an inhibitor-releasing compound that releases a density inhibitor upon thermal development.

Preferably, the method of exposure first entails making a light-tight film packet containing the photothermographic element in combination with one or more intensifying means, which intensifying means can be, for example, phosphor intensifying screens, phosphors incorporated within the photothermographic emulsion, or with a combination thereof. The intensifying means, if not incorporated within the emulsion, can still be a unitary or integral part of the photothermographic element. In this case, the photothermographic element or material can be optionally exposed directly to ionizing radiation. By "unitary" or "integral" is meant that the intensifying means is not readily separable from the photothermographic material comprising the silver-halide emulsion and is, therefore, is adapted for being subjected to thermal development together with the photothermographic material. For example, the photothermographic element can comprise a multi-layer structure comprising a coated layer of an intensifying means and a coated imaging layer. Alternatively, an intensifying means can be an intensifying screen or the like adapted for physical separation from the photothermographic element in which case the intensifying element and the photothermographic element are employed in combination.

In any case, the combination of the photothermographic material, comprising an imaging layer, and the intensifying means will be referred to herein as an imaging or photothermographic "assembly" irrespective of whether the intensifying means is part of the developable material or separable therefrom. Unless otherwise indicated, a photothermographic "element" is a photothermographic material that may optionally comprise an incorporated intensifying means and/or which may be used in an assembly that comprises a separable intensifying element and thermally developed photothermographic element. Thus, the photothermographic element can be a photothermographic assembly or part of one.

In one embodiment of the invention, for example, the photothermographic material is exposed by visible-light emitting phosphor particles coated on a support, which support is separate from the support for the silver-halide emulsion in the photothermographic material, to form an external phosphor screen. The phosphor particles emit light in response to impinging ionizing radiation. The method of exposure first entails making a light-tight film packet of the photothermographic element and the external screen. In the film packet, the photothermographic element and phosphor-containing layer of the external screen are in face-to-face contact. The object to be imaged is then placed between the film packet and the source of ionizing radiation. The object modulates the x-ray exposure to produce an x-ray transmission image that penetrates the film packet and is absorbed by the external screen. The external screen converts the x-ray energy into visible-light energy that is recorded by the photothermographic element in the form of a latent silver image. During thermal development of the photothermographic element, a density-inhibiting agent inhibits the thermal (fog-density) development of unexposed silver particles (density) in the exposed areas relative to the unexposed areas of the element to produce a positive image in the photothermographic film.

In another embodiment, the photothermographic element comprises in part an internal phosphor, that is internal to, and integral with, the photothermographic element. The internal phosphor performs the same function as the external phosphor screen but it is coated within the photothermographic element. The internal phosphor may occupy the same layer as the silver halide emulsion or can be in a nearby layer of the photothermographic element. An internal phosphor may preclude the need for an external phosphor screen. In a preferred embodiment, one or more couplers or the like is present in the photothermographic element to accelerate development by removing Dox as it is formed, in order to drive development to Dmax.

Without wishing to be bound by theory, it is believed that thermal development in the present invention comprises (in order) two stages: a first stage comprising amplification of the latent image to form a relatively low-contrast negative image; and a second stage comprising imagewise inhibition of fog development (by an agent released by an inhibitor-releasing compound) to form a final relatively high-contrast positive image.

The present invention is also directed to a photothermographic element that can be used in the present process.

The present invention has the advantage of high speeds. In fact, the above-mentioned second-stage positive image, taken to full development in the unexposed areas, can be at least two stops faster than the first-stage negative image. Thus, the inventive method and accompanying photothermographic element can form a positive image of high speed and discrimination when exposed and heated 10 to 40 sec at 150 to 185° C. Images have excellent thermal and light stability. Dmins (minimum densities) are stable after extended incubation to heat or light. These and other advantages will be apparent from the detailed description below.

Definitions of other terms, as used herein, include the following:

In the descriptions of the photothermographic materials of the present invention, "a" or "an" component refers to "at least one" of that component.

Heating in a substantially water-free condition as used herein, means heating at a temperature of from about 150° C. to about 200° C. with little more than ambient water vapor present. The term "substantially water-free condition" means that the reaction system is approximately in equilibrium with water in the air, and water for inducing or promoting the reaction is not particularly or positively supplied from the exterior to the material. Such a condition is described in T. H. James, *The Theory of the Photographic Process*, Fourth Edition, Macmillan 1977, p 374.

"Emulsion layer," "imaging layer," or "photothermographic emulsion layer," means a layer of a photothermographic material that contains the photosensitive silver halide (when used) and non-photosensitive source of reducible silver ions.

"Non-photosensitive" means not intentionally light sensitive.

The term "organic silver salt" is herein meant to include salts as well as ligands comprising two ionized species. The silver salts used are preferably comprised of silver salts of organic coordinating ligands. Many examples of such organic coordinating ligands are described below. The silver donors can comprise asymmetrical silver donors or dimers such as disclosed in commonly assigned U.S. Pat. No. 5,466,804 to Whitcomb et al. In the case of such dimers, they are considered to be two separate organic silver salts such that only one silver atom is attributed to each organic silver salt. Organic silver salts can be in the form of core-shell particles as disclosed in commonly assigned U.S. Pat. No. 6,548,236.

The terms "blocked developer" and "developer precursor" are the same and are meant to include developer precursors, blocked developer, hindered developers, and developers with blocking and/or timing groups, wherein the term "developer" is used to indicate a reducing substance for silver ion.

The term "image" and "imagewise" broadly refers, in one case, to any image or visual representation, including a picture, indicia, print, symbol, or positive indication or readout, including reproductions characterized by photographic-quality images as well as information-providing representations, including measurement indicators or signifiers such as a radiation dosimeter.

"Ultraviolet region of the spectrum" refers to that region of the spectrum less than or equal to 410 nm and preferably from about 100 nm to about 410 nm, although parts of these ranges may be visible to the naked human eye. More preferably, the ultraviolet region of the spectrum is the region from about 190 nm to about 405 nm.

"Short wavelength visible region of the spectrum" refers to that region of the spectrum from about 400 nm to about 450 nm.

"Visible region of the spectrum" refers to that region of the spectrum from about 400 nm to about 700 nm.

"Red region of the spectrum" refers to that region of the spectrum from about 600 nm to about 700 nm.

"Infrared region of the spectrum" refers to that region of the spectrum from about 700 nm to about 1400 nm.

"Middle chalcogen" means sulfur (S), selenium (Se), or tellurium (Te).

"Non-photosensitive" means not intentionally light sensitive.

"Transparent" means capable of transmitting visible light or imaging radiation without appreciable scattering or absorption.

A "Phosphor" is an organic or inorganic compound that is responsive to ionizing radiation and more preferably x-radiation and, upon irradiation, emits radiation in the ultraviolet, visible, or infrared region of the spectrum. Most phosphors emit such radiation immediately upon exposure to stimulating radiation. However, some phosphors are known as "storage" phosphors because they have the capacity to store energy from the initial irradiation and to release the light at a later time when stimulated by still other radiation. Another class of phosphors are known as "thermoluminescent" phosphors because they have the capacity to store energy from the initial irradiation and to release the light at a later time when stimulated by heat.

The term "kVp" and "MVp" stand for peak voltage applied to an x-ray tube times $10^3$ and $10^6$ respectively. The term "mA" stands for the milliamperes of current applied between the anode and the cathode of the x-ray tube during exposure. The term "dose" refers to the exposure received by a given object when irradiated. Dose is measured either in units of "Rads" (1 Rad is the energy absorption of 100 ergs per gram of tissue) or the dose equivalent units known as "Rems." "mRems" stands for "Rems" times $10^{-3}$.

DETAILED DESCRIPTION OF THE INVENTION

Figure 1:
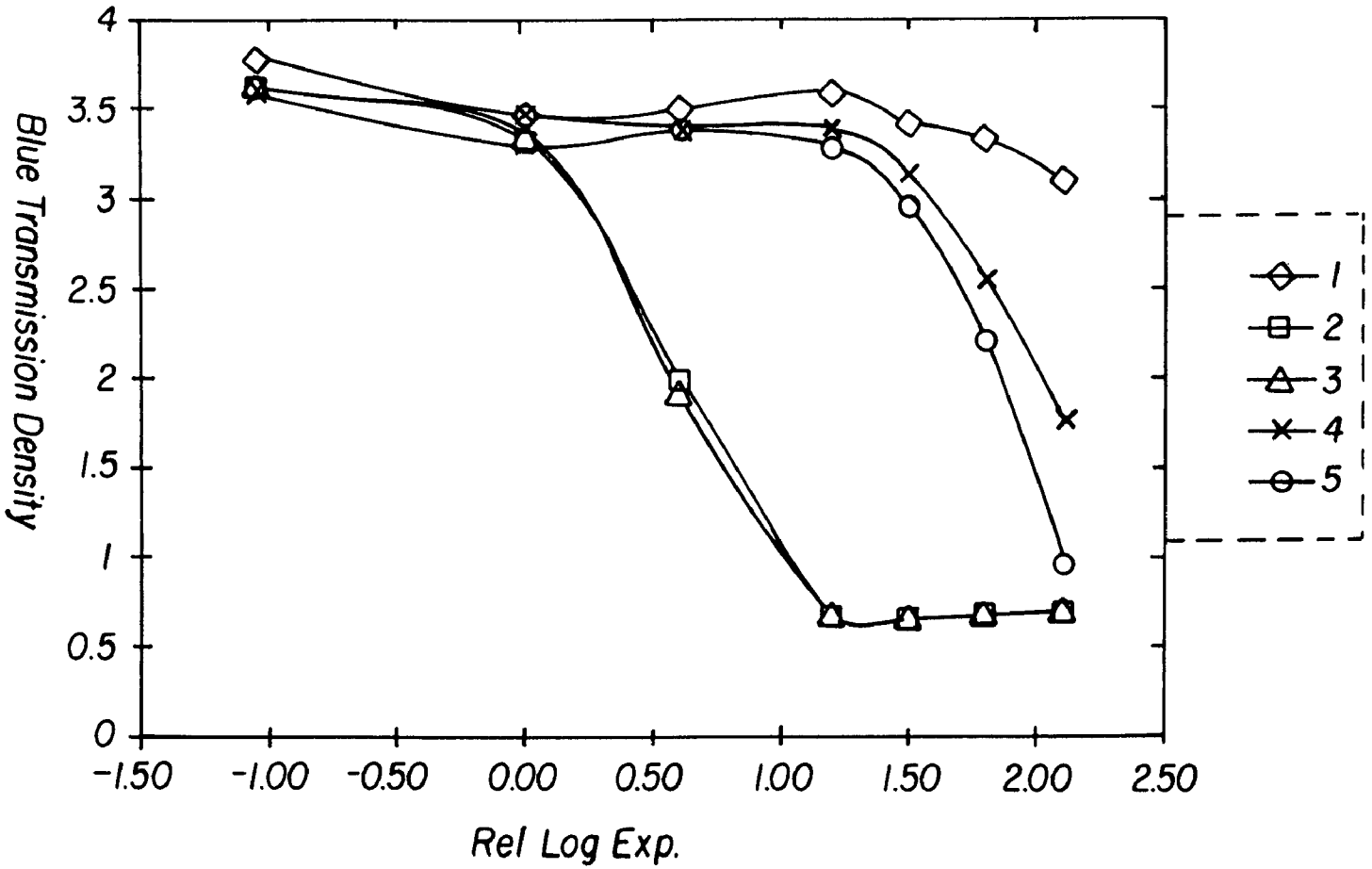
FIG. 1 is a graph (blue transmission density vs relative log exposure) showing the effect of different external phosphor screens on the photographic H&D curve for one embodiment of a photothermographic film according to the present invention as described in Example 2 below.

According to the method of the present invention, a positive image is formed in a photothermographic element (such as film), comprising a potentially negative-working emulsion, by employing an inhibitor-releasing compound that imagewise inhibits fog-density development in exposed areas of the image during thermal development, which photothermographic element comprises, or is used in combination with, an intensifying means. The intensifying means is an element or material that converts ionizing radiation into a form that is useful for imagewise exposing the photothermographic element resulting in the formation of a latent image. The combination of the photothermographic material, comprising an imaging layer, and the intensifying means will be referred to herein as an imaging or photothermographic "assembly" irrespective of whether the intensifying means is part of the developable material or separable therefrom. Unless otherwise indicated, a photothermographic "element" is a photothermographic material that may optionally comprise an incorporated intensifying means and/or which may be used in an assembly that comprises a separable intensifying element and thermally developed photothermographic element. Thus, the photothermographic element can be a photothermographic assembly or part of one.

According to the method of the present invention, thermal development of unexposed silver salts in the exposed areas is inhibited relative to the unexposed areas, with the proviso that the element is imagewise exposed with a non-solarizing amount of ionizing radiation or a non-solarizing amount of actinic radiation emitted from an intensifying means in response to excitation from ionizing radiation in order to form a latent image, and the latent image is thermally developed in a single development step, without any reversal steps or additional exposures to actinic radiation, to produce a positive image in the film. The above-mentioned inhibition is believed to be caused by an density-inhibiting agent that may be present or released during thermal development, for example, released by a density-inhibitor-releasing compound (as in believed to occur in a preferred embodiment) but, in any case, the key is that inhibition is accomplished.

In another aspect of the present invention, a photothermographic element, comprising at least one image-forming layer coated on a support, said layer comprising at least one photographically active silver-halide emulsion spectrally sensitized to visible light and at least one non-light-sensitive organic silver salt), following imagewise exposure to actinic radiation from an intensifying means which in turn is exposed to ionizing radiations, is developed by heating at 150–200° C., to develop an imagewise reduced-silver image that is physically separate and morphologically distinct from the developed latent-image silver associated with the silver-halide grains. In one preferred embodiment, the photothermographic element comprises at least one non-light sensitive organic silver salt which releases the inhibitor-releasing compound.

The present invention involves forming a high-speed, stable positive image when a photothermographic material is thermally developed in the presence or absence of the intensifying means for converting ionizing radiation. In the preferred embodiment, at least one imaging layer comprises a negative-working silver-halide emulsion, at least one non-light sensitive silver salt, an inhibitor-releasing compound, a developer or precursor thereof, and preferably a scavenging agent for the oxidized developer Dox.

In one preferred embodiment, for example, at least one imaging layer comprises a negative-working silver halide emulsion, at least one non-light-sensitive silver salt which functions as an inhibitor-releasing compound, a blocked phenylenediamine developer, a phenolic developer/coupler, and a thermal solvent, for example, a hydroxy-substituted benzamide. One may also incorporate optional toners and accelerators known in the trade, examples of which include succinimide, phthalimide, naphthalimide, phthalazine, and phthalazinone. Other components that can be used are described in U.S. Patent Publication 2004/0033447 A1, hereby incorporated by reference it its entirety.

The intensifying means for converting ionizing radiation may be a visible-light emitting phosphor in the imaging layer or adjacent layers or a metal foil in adjacent layers. After exposure to ionizing radiation the photothermographic emulsion develops a positive image when the exposed invention element is heated at a temperature of at least 150° C. for at least 20 sec, preferably at least 155° C. for at least 20 sec, most preferably 160° C. for 20 to 40 sec. Images can be formed having excellent discrimination and are resistant to print out. To Applicants' knowledge, this is the first example of photothermographic element incorporating a negative-working emulsion that develops a positive image when given a non-solarizing exposure of actinic radiation from an intensifying means in response to ionizing radiation, in the absence of multiple development steps as in reversal development. In contrast, a solarizing exposure is an extended exposure beyond the level required to produce a stable latent image. Less density develops in this case because the extended exposure causes the release of sufficient halogen to reoxidize the latent image. By the phrase "absence of multiple development steps" is meant that development occurs in a single unit-process step. Full development can occur during a heating step wherein once the film is heated to initiate development the development is complete before bringing the film back to temperature below which thermal development is initiated. For example, in one embodiment, the development is initiated above 150° C. and completed before bringing the temperature below 150° C. There are no separate reversal steps, or reexposures of the photographic element, for complete development. Instead, thermal development, involving both a relatively low-contrast negative image and its change to a final positive image, occurs in a single or continuous heating step.

Without wishing to be bound by theory, the Applicants believe the following events occur during the present process. In an initial stage of thermal development, latent image amplification occurs in the normal sense to produce a low-contrast negative image. During this initial stage, a development inhibitor is released. The inhibitor is believed to shut down negative-image development shortly after initiation. In a second stage of thermal development, in which unexposed silver halide and non-light-sensitive silver salts are thermally developed or reduced to silver (referred to as "fogging") at sufficiently high temperature, the developed density in the initial negative-image development stage becomes the Dmin of the final positive image. A coupler, if present, may react with oxidized developer to form a negative image consisting of dye plus silver. Colors can appear quite saturated in the negative image. With continued heating the exposed areas resist further development while the unexposed areas rapidly develop to a high-density fog.

If a coupler is present, the hue may appear less saturated in the unexposed areas. The result is a positive two-toned image possessing high speed and excellent light stability, suitable for scanning or, in some cases, for direct viewing.

Electron micrographs reveal that, during the second stage of thermal development, some of the silver development can occur off-grain and may involve the photographically inactive non-halide silver ion donors during dry physical development. Increasing exposure of the negative-working photosensitive silver halide grains results in less off-grain silver development. This provides the advantage of increased covering power and developed density in the areas of least exposure.

Without wishing to be bound by theory, the Applicants postulate that positive-image development occurs via formation of a sphere of inhibition around the exposed and partially developed negative-working silver-halide grains.

In a preferred embodiment, two different silver ion donors are present in the imaging layer, one or both of which release a development or density-inhibiting agent. However, other sources of the development inhibitor can be used, for example, as a PUG (photographically useful group) that is releasable from a coupler or other compound present in the imaging layer. For example, in one embodiment of the invention, phenylmercaptotetrazole (PMT) or benzotriazole, two known development inhibitors commonly used in the trade to make DIR couplers (development-inhibitor-releasing couplers), are believed to accumulate during the initial stage of dry physical development in the vicinity of the partially amplified negative image, when only the latent image develops. It is postulated that at a critical concentration, the inhibitor shuts down further latent-image development and also slows the rate of fog formation or development in the exposed areas. The unexposed areas appear to produce fog at a normally high kinetic rate, fast enough to develop to a high density before released inhibitor can shut down development. The result is a positive image having high discrimination and speed.

In a preferred embodiment, the photographic speed of a given negative-working emulsion in the dry reversal coating format is 2–3 stops higher in photographic speed compared to conventional solution-processed or thermal-processed coatings that produce a negative image. Images are quite stable to extended exposure to light.

In one embodiment of the invention, in which the photographic element comprises two organic silver salts, the first organic silver salt exhibits a pKsp difference of at least 0.5, preferably at least 1.0, more preferably at least 2.0 less than the pKsp of the second organic silver salt or ligand. In one particularly preferred embodiment, the first organic silver ligand exhibits a cLogP of 0.1 to 10 and a pKsp of 7 to 14 and the second organic silver ligand exhibits a cLogP of 0.1 to 10 and a pKsp of 14 to 21. In another embodiment, the first organic silver salt, or salt of the first type, has a pKsp of 9 to 16 and the second organic silver salt, or the organic silver salt of the second type, has a pKsp of 12 to 19.

In another embodiment, the organic ligands used to make the first and second silver salts are combined together to form a single mixed silver salt of various molar compositions.

When individual organic silver salts are used, both organic silver salts are present at levels above 5 g/mol of imaging silver halide. Preferably, the first organic silver salt is primarily the silver donor during the initial stage of thermal development (or the more reactive silver donor), at levels in the range of 5 to 3,000 g/mol of imaging silver halide. Preferably, the second organic silver salt acts as the thermal fog inhibitor, in the first stage of thermal development, and is present at levels in the range of 5 to 3,000 g/mol of imaging silver halide. Preferably, molar ratio of said first organic silver salt to said second organic silver salt is from about 0.1:10 to about 10:1.

In a preferred embodiment of the present invention, a photothermographic element has on a support one or more one light-sensitive imaging layers, each of said imaging layers comprising a light-sensitive silver emulsion, a binder, a dye-providing coupler or other Dox scavenger, and a developer or blocked developer. Preferably, the dyes or other compounds formed from the Dox scavenger in the layers are capable of forming a dye image of a visible or non-visible color. By the term "visible or non-visible colors" is meant that colorless compounds may absorb light outside the visible wavelength region (400–700 nm).

Although the minimum value of the indicated difference in pKsp is 0.5, preferably the difference in pKsp is at least 1.0, more preferably at least 2.0. The lower the temperature onset, however, the less the difference in pKsp that is needed. In one embodiment of the invention, both the first and second organic silver salt, or both the first and second type of organic silver salt, have a pKsp of greater than 11, preferably greater than 12, and neither are silver carboxylates, including silver behenate.

The activity solubility product or $pK_{sp}$ of an organic silver salt is a measure of its solubility in water. Some organic silver salts are only sparingly soluble and their solubility products are disclosed, for example, in Chapter 1 pages 7–10 of *The Theory of the Photographic Process*, by T. H. James, Macmillan Publishing Co. Inc., New Your (fourth edition 1977). Many of the organic silver salts consist of the replacement of a ligand proton with Ag+. The silver salts derived from mercapto compounds are relatively less soluble. The compound PMT has a $pK_{sp}$ of 16.2 at 25° C. as reported by Z. C. H. Tan et al., *Anal. Chem.,* 44, 411 (1972); Z. C. H. Tan, *Phototgr. Sci. Eng.,* 19, 17 (1975). In comparison, benzotriazole, for example, has a $pK_{sp}$ of 13.5 at a temperature of 25° C. as reported by C. J. Battaglia, *Photogr. Sci. Eng.,* 14, 275 (1970).

In a preferred embodiment, the primary source of reducible, non-photosensitive silver in the practice of this invention are organic silver salts described as having the lower pKsp.

The first organic silver salt, or first type of organic silver salt, is preferably a non-photosensitive source of reducible silver ions (that is, silver salts) and can be any compound that contains reducible silver (1+) ions. Preferably, it is a silver salt that is comparatively stable to light and forms a silver image when heated to 50° C. or higher in the presence of an exposed photocatalyst (such as silver halide) and a reducing composition. In the imaging layer of the element, the photocatalyst and the non-photosensitive source of reducible silver ions must be in catalytic proximity (that is, reactive association). "Catalytic proximity" or "reactive association" means that they should be in the same layer, or in adjacent layers. It is preferred that these reactive components be present in the same emulsion layer.

According to the present invention, the organic silver salt referred to as the "organic silver donor" or "the first organic silver salt" or "organic silver salt of the first type" is generally the oxidatively more reactive organic silver salt compared to the second organic silver salt or second type of organic silver salt. This more reactive organic silver salt is preferably a silver salt of a nitrogen acid (imine) group, which can optionally be part of the ring structure of a heterocyclic compound. Aliphatic and aromatic carboxylic acids such as silver behenate or silver benzoate, in which the silver is associated with the carboxylic acid moiety, are specifically excluded as the organic silver donor compound. Compounds that have both a nitrogen acid moiety and carboxylic acid moiety are included as donors of this invention only insofar as the silver ion is associated with the nitrogen acid rather than the carboxylic acid group. The donor can also contain a mercapto residue, provided that the sulfur does not bind silver too strongly, and is preferably not a thiol or thione compound.

More preferably, a silver salt of a compound containing an imino group present in a heterocyclic nucleus can be used. Typical preferred heterocyclic nuclei include triazole, oxazole, thiazole, thiazoline, imidazoline, imidazole, diazole, pyridine and triazine. Examples of the first organic silver salt include derivatives of a tetrazole. Specific examples include but are not limited to 1H-tetrazole, 5-ethyl-1H-tetrazole, 5-amino-1H-tetrazole, 5-4'methoxyphenyl-1H-tetrazole, and 5-4'carboxyphenyl-1H-tetrazole.

The organic silver salt may also be a derivative of an imidazole. Specific examples include but are not limited to benzimidazole, 5-methyl-benzimidazole, imidazole, 2-methyl-benzimidazole, and 2-methyl-5-nitro-benzimidazole. The organic silver salt may also be a derivative of a pyrazole. Specific examples include but are not limited to pyrazole, 3,4-methyl-pyrazole, and 3-phenyl-pyrazole.

The organic silver salt may also be a derivative of a triazole. Specific examples include but are not limited to benzotriazole, 1H-1,2,4-trazole, 3-amino-1,2,4 triazole, 3-amino-5-benzylmercapto-1,2,4-triazole, 5,6-dimethyl benzotriazole, 5-chloro benzotriazole, and 4-nitro-6-chloro-benzotriazole.

Other silver salts of nitrogen acids may also be used. Examples would include but not be limited to o-benzoic sulfimide, 4-hydroxy-6-methyl-1,3,3A,7-tetraazaindene, 4-hydroxy-6-methyl-1,2,3,3A,7-pentaazaindene, urazole, and 4-hydroxy-5-bromo-6-methyl-1,2,3,3A,7-pentaazaindene.

Most preferred examples of the organic silver donor compounds include the silver salts of benzotriazole, triazole, and derivatives thereof, as mentioned above and also described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, a silver salt of 1H-tetrazole as described in U.S. Pat. No. 4,220,709.

Silver salt complexes may be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029 (June 1978), as well as U.S. Pat. No. 3,700,458 and published Japanese patent applications Nos. 32928/75, 13224/74, 17216/75 and 42729/76.

Preferably, at least one organic silver donor is selected from one of the above-described compounds.

In a preferred embodiment, an oxidatively less reactive silver salt (the "second organic silver salt" or organic silver salt of the second type") is selected from silver salts of thiol or thione substituted compounds having a heterocyclic nucleus containing 5 or 6 ring atoms, at least one of which is nitrogen, with other ring atoms including carbon and up to two heteroatoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-1-methyl-2-phenyl-4-thiopyridine, a silver salt of mercaptotriazine, a silver salt of 2-mercaptobenzoxazole. These silver salts are herein referred to as "oxidatively less reactive silver salts."

The oxidatively less reactive silver salt may be a derivative of a thionamide. Specific examples would include but not be limited to the silver salts of 6-chloro-2-mercapto benzothiazole, 2-mercapto-thiazole, naptho(1,2-d)thiazole-2(1H)-thione, 4-methyl-4-thiazoline-2-thione, 2-thiazolidinethione, 4,5-dimethyl-4-thiazoline-2-thione, 4-methyl-5-carboxy-4-thiazoline-2-thione, and 3-(2-carboxyethyl)-4-methyl-4-thiazoline-2-thione.

Preferably, the oxidatively less reactive silver salt is a derivative of a mercapto-triazole. Specific examples would include, but not be limited to, a silver salt of 3-mercapto-4-phenyl-1,2,4 triazole and a silver salt of 3-mercapto-1,2,4-triazole.

Most preferably the oxidatively less reactive silver salt is a derivative of a mercapto-tetrazole. In one preferred embodiment, a mercapto-tetrazole compound useful in the present invention is represented by the following structure:

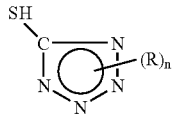

wherein n is 0 or 1, and R is independently selected from the group consisting of substituted or unsubstituted alkyl, aralkyl, or aryl. Substituents include, but are not limited to, C1 to C6 alkyl, nitro, halogen, and the like, which substituents do not adversely affect the thermal fog inhibiting effect of the silver salt. Preferably, n is 1 and R is an alkyl having 1 to 16 carbon atoms or a substituted or unsubstituted phenyl group. Specific examples include but are not limited to silver salts of 1-phenyl-5-mercapto-tetrazole, 1-(3-acetamido)-5-mercapto-tetrazole, or 1-[3-(2-sulfo)benzamidophenyl]-5-mercapto-tetrazole.

In one embodiment of the invention, a first organic silver salt is a benzotriazole or derivative thereof and a second organic silver salt is a mercapto-functional compound, preferably mercapto-heterocyclic compound. Particularly preferred is 1-phenyl-5-mercapto-tetrazole (PMT).

In general, an organic silver salt is formed by mixing silver nitrate and other salts with the free base of the organic ligand such as PMT. By raising the pH sufficiently with alkaline base, the silver salt of PMT can be precipitated, typically in spheroids 20 nm in diameter and larger.

In a particularly preferred embodiment, the photothermographic element comprises at least one image forming layer coated on a support, wherein said layer comprises at least one silver halide emulsion, optionally chemically and spectrally sensitized to visible or infrared radiation, an organic silver salt having Structure (I), a silver salt having Structure (II) below, an optional thermal solvent selected from Structures (IIIA–IIIC), a phenolic coupler of Structure (IV) below, and an amine developer or precursor thereof having Structure (V) below. Such an element is capable of producing a positive image after a single exposure and single thermal development unit step.

The silver salt of Structure (I) has the general structure:

(I)

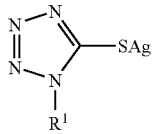

wherein $R^1$ is alkyl, cycloalkyl, substituted alkyl, phenyl, aryl, substituted aryl or phenyl.

The silver salt of Structure (II) has the general structure:

(II)

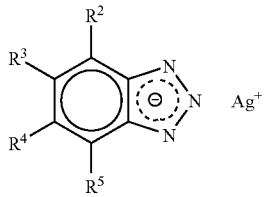

wherein $R^2$, $R^3$, $R^4$, and $R^5$ may be independently selected from hydrogen, halide, alkyl, alkoxy, aryl, phenyl, phenoxy, carboxy, alkyl, cycloalkyl, substituted alkyl, substituted aryl, substituted phenyl, wherein said substituted alkyl, aryl or phenyl groups may also contain O, N, S, halide, sulfonic acid, sulfone, sulfonamide, carboxylic acid, ester, aldehyde, ketone, amine, or amide; and wherein at least two of $R^2$, $R^3$, $R^4$, and $R^5$ may be part of an additional ring structure.

In another embodiment mixed silver salts of the organic ligands used to make Structure (I) and Structure (II) may be preferred over the individual salts. An example is a mixed salt comprising silver, benzotriazole, and PMT in the molar ratio of 1:0.5:0.5. Prior art thermal solvents for a heat processed photographic elements are disclosed in U.S. Pat. No. 6,277,537, U.S. Pat. No. 5,436,109; U.S. Pat. No. 5,843,618, U.S. Pat. No. 5,480,761, U.S. Pat. No. 5,480,760, U.S. Pat. No. 5,468,587, U.S. Pat. No. 5,352,561, U.S. Pat. No. 5,064,742. These are also useful in the current invention although optional. When used, preferred thermal solvents have a hydroxy-benzamide structure as shown in Structures (IIIA)–(IIIC):

(IIIA)

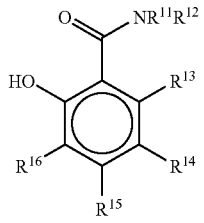

-continued (IIIB)

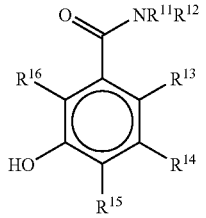

(IIIC)

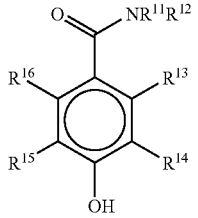

wherein $R^{11}$, $R^{12}$, $R^{13}$, $R^{14}$, $R^{15}$, and $R^{16}$, which can be the same or different individually, can be hydrogen, alkyl, substituted alkyl, alkenyl, substituted alkenyl, aryl, substituted aryl, halogen, cyano, alkoxy, substituted alkoxy, aryloxy, substituted aryloxy, amino, substituted amino, alkylcarbonamido, substituted alkylcarbonamido, arylcarbonamido, substituted arylcarbonamido, alkylsulfonamido, arylsulfonamido, substituted alkylsulfonamido, substituted arylsulfonamido, or sulfamyl; or wherein at least two of $R^{11}$, $R^{12}$, $R^{13}$, $R^{14}$, $R^{15}$, and $R^{16}$ together can further form a substituted or unsubstituted carbocyclic or heterocyclic ring structure that can further be substituted or unsubstituted.

Representative thermal solvents include:

TS-1

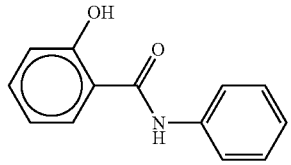

TS-2

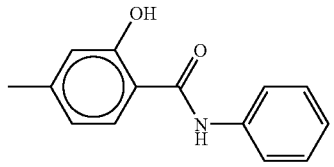

TS-3

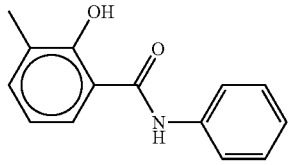

TS-4

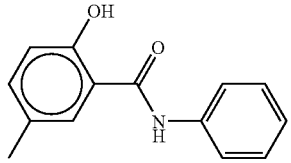

-continued

TS-5

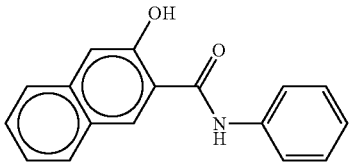

TS-6

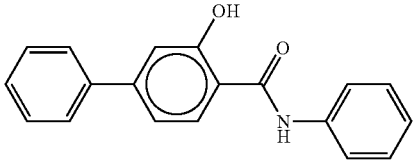

TS-7

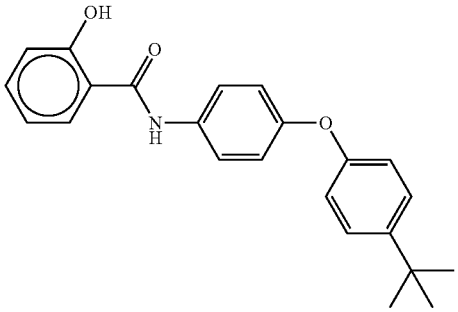

The phenolic coupler of Structure (IV) has the general structure:

(IV)

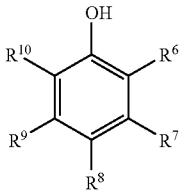

wherein $R^6$, $R^7$, $R^8$, $R^9$ and $R^{10}$ may independently be selected from hydrogen, hydroxyl, alkyl, alkoxy,

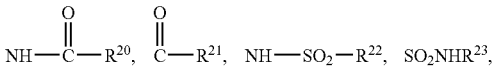

wherein $R^{20}$, $R^{21}$, $R^{22}$, $R^{23}$ are independently selected from alkyl, haloalkyl, hydroxyl, amino, substituted amino, arylamino, substituted arylamino, aryl, substituted aryl, phenyl, substituted phenyl, alkoxy, aryloxy, substituted aryloxy, phenoxy, and substituted phenoxy, or wherein at least two of $R^7$, $R^8$, and $R^9$ together can further form a substituted or unsubstituted carbocyclic or heterocyclic ring structure. Such compounds are exemplified by, and include all the couplers disclosed in GB 2018453A to Willis, hereby incorporated by reference in its entirety.

Such couplers have the property that they are relatively inactive as couplers. This allows them to function as Dox scavengers to maximize Dmax in the positive image while, at the same time, minimizing the Dmin (or Dmax of the temporary or low-contrast negative image) during thermal development.

Some phenolic couplers may also behave as thermal solvents. It is preferable that one material satisfy more than one function, but it is not necessary.

Examples of phenolic couplers include:

PC-1

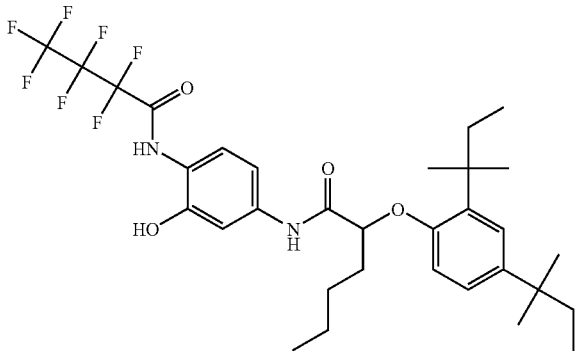

PC-2

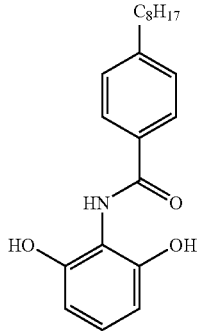

PC-3

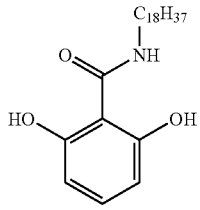

PC-4

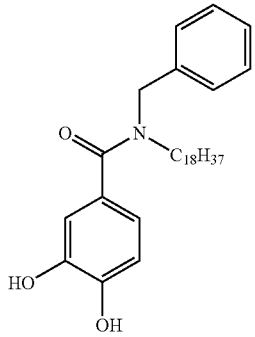

As indicated above, a photothermographic process typically employs blocked developers that decompose (i.e., unblock) on thermal activation to release a developing agent. By a "dry thermal process" or "dry photothermographic" process is meant herein a process involving, after imagewise exposure of the photothermographic element, developing the resulting latent image by the use of heat to raise the temperature of the photothermographic element or film to a temperature of at least about 150° C., preferably at least about 155° C., more preferably at about 160° C. to 180° C., without liquid processing of the film, preferably in an essentially dry process without the application of aqueous solutions. By an essentially dry process is meant a process that does not involve the uniform saturation of the film with a liquid, solvent, or aqueous solution. Thus, contrary to photothermographic processing involving low-volume liquid processing, the amount of water required is less than 1 times, preferably less than 0.4 times and more preferably less than 0.1 times the amount required for maximally swelling total coated layers of the film excluding a back layer. Most preferably, no liquid is required or applied added to the film during thermal treatment. Preferably, no laminates are required to be intimately contacted with the film in the presence of aqueous solution.

Preferably, during thermal development an internally located blocked developing agent in reactive association with each of light-sensitive layers becomes unblocked to form a developing agent, whereby the unblocked developing agent is imagewise oxidized on development and this oxidized form reacts with the dye-providing couplers or other Dox scavenger.

The components of the photothermographic element can be in any location in the element that provides the desired image. If desired, one or more of the components can be in one or more layers of the element. For example, in some cases, it is desirable to include certain percentages of the reducing agent, toner, thermal solvent, stabilizer and/or other addenda in the overcoat layer over the photothermographic image recording layer of the element. This, in some cases, reduces migration of certain addenda in the layers of the element.

It is necessary that the components of the photographic combination be "in association" with each other in order to produce the desired image. The term "in association" herein means that in the photothermographic element the photographic silver halide and other components of the image-forming combination are in a location with respect to each other that enables the desired processing and forms a useful image. This may include the location of components in different layers.

Preferably, development processing is carried out (i) for less than 60 seconds, (ii) at the temperature from 150 to 200° C., and (iii) without the application of any aqueous solution.

In view of advances in the art of scanning technologies, it has now become natural and practical for photothermographic films such as disclosed in EP 0762 201 to be scanned, which can be accomplished without the necessity of removing the silver or silver halide from the negative, although special arrangements for such scanning can be made to improve its quality. See, for example, Simons U.S. Pat. No. 5,391,443. Method for the scanning of such films are also disclosed in commonly assigned U.S. Pat. No. 6,521,384, issued Feb. 18, 2003, hereby incorporated by reference in its entirety.

A simple technique is to scan the photographic element point-by-point along a series of laterally offset parallel scan paths. A sensor that converts radiation received into an electrical signal notes the intensity of light passing through the element at a scanning point. Most generally this electronic signal is further manipulated to form a useful electronic record of the image. For example, the electrical signal can be passed through an analog-to-digital converter and sent to a digital computer together with location information required for pixel (point) location within the image. The number of pixels collected in this manner can be varied as dictated by the desired image quality. Very low resolution images can have pixel counts of 192×128 pixels per film frame, low resolution 384×256 pixels per frame, medium resolution 768×512 pixels per frame, high resolution 1536×1024 pixels per frame and very high resolution 3072×2048 pixels per frame or even 6144×4096 pixels per frame or even more. Higher pixel counts or higher resolution translates into higher quality images because it enables higher sharpness and the ability to distinguish finer details especially at higher magnifications at viewing. These pixel counts relate to image frames having an aspect ratio of 1.5 to 1. Other pixel counts and frame aspect ratios can be employed as known in the art. Most generally, a difference of four times between the number of pixels rendered per frame can lead to a noticeable difference in picture quality, while differences of sixteen times or sixty four times are even more preferred in situations where a low quality image is to be presented for approval or preview purposes but a higher quality image is desired for final delivery to a customer. On digitization, these scans can have a bit depth of between 6 bits per color per pixel and 16 bits per color per pixel or even more. The bit depth can preferably be between 8 bits and 12 bits per color per pixel. Larger bit depth translates into higher quality images because it enables superior tone and color quality.

Both large and small format frames are used in radiography. Most radiography is done with monochrome films and the image is digitized using a 12 bit or 14 bit grey scale. Many different film sizes are used for medical diagnosis in humans. Intra-oral dental radiography for humans uses frame sizes from 22 mm×35 mm to as large as 57 mm×76 mm. Medical imaging application for humans uses a variety of frame sizes depending on the patient size with the largest common frame size being around 43 cm×43 cm. The resolution required for scanning of frames for medical applications depends on the type of exam performed. Mammography exams using 24 cm×30 cm frame sizes can be digitized at 12 bits depth grey scale and, for example, 3200×4600 pixels per frame. Chest exams generally use larger frames' (35 cm×43 cm) and often are digitized at lower resolution (for example, 2800×3400 pixels per frame) with a grey scale bit depth of 12. Veterinary applications can use the similar or different film and frame sizes according to the application. Industrial radiography can use much large film sizes for the radiographic examinations of, for example, structural defects in welds. Film sizes up to 40 cm×80 cm or larger can be used. Digitization of industrial films is done with varying frame size and resolution depending on the image.

The electronic signal can form an electronic record that is suitable to allow reconstruction of the image into viewable forms such as computer monitor displayed images, television images, optically, mechanically or digitally printed images and displays and so forth all as known in the art. The formed image can be stored or transmitted to enable further manipulation or viewing, such as in U.S. Ser. No. 09/592,816 titled AN IMAGE PROCESSING AND MANIPULATION SYSTEM to Richard P. Szajewski, Alan Sowinski and John Buhr.

The support for the photothermographic element can be either reflective or transparent, which is usually preferred. When reflective, the support is white and can take the form of any conventional support currently employed in print elements. When the support is transparent, it can be colorless or tinted and can take the form of any conventional support currently employed in photographic film elements—e.g., a colorless or tinted transparent film support. Details of support construction are well understood in the art. Examples of useful supports are poly(vinylacetal) film, polystyrene film, poly(ethyleneterephthalate) film, poly(ethylene naphthalate) film, polycarbonate film, and related films and resinous materials, as well as paper, cloth, glass, metal, and other supports that withstand the anticipated processing conditions.

The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure* I.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Any convenient selection from among conventional radiation-sensitive silver-halide emulsions can be incorporated within the layer units and used to provide the spectral absorptances of the invention. Most commonly, high bromide emulsions containing a minor amount of iodide are employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thickness are less than 0.3 μm (most preferably less than 0.2 μm). Ultra thin tabular grain emulsions, those with mean tabular grain thickness of less than 0.07 μm, are specifically contemplated. The grains preferably form surface latent images so that they are capable of producing negative images when processed in a solution surface developer.

Illustrations of conventional radiation-sensitive silver halide emulsions are provided by *Research Disclosure* I, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver-halide grains to be used in the invention may be prepared according to methods known in the art, such as those described in *Research Disclosure* I, cited above, and T. H. James, *The Theory of the Photographic Process*, Fourth Edition, Macmillan Publishing Co., Inc., 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al. U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure*, Item 36736, November 1994, herein incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure* I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements.

The photographic elements may further contain other image-modifying compounds such as "Development-Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613. DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the photothermographic embodiment of the invention is preferably subdivided into at least two, and more preferably three or more sub-unit layers. It is preferred that all light-sensitive silver-halide emulsions in the image recording unit have spectral sensitivity in the same region of the ultraviolet or visible spectrum. In this embodiment, while all silver-halide emulsions incorporated in the unit have spectral absorptances according to invention, it is expected that there are minor differences in spectral absorptance properties between them. In still more preferred embodiments, the sensitizations of the slower silver-halide emulsions are specifically tailored to account for the light-shielding effects of the faster silver-halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The photothermographic element may comprise an anti-halation layer unit that contains a decolorizable light absorbing material, such as one or a combination of pigments and dyes. Suitable materials can be selected from among those disclosed in *Research Disclosure* I, Section VIII. Absorbing materials.

The photothermographic element may further comprise a surface overcoat SOC which are typically hydrophilic colloid layers that are provided for physical protection of the elements during handling and processing. Each SOC also provides a convenient location for incorporation of addenda that are most effective at or near the surface of the element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers optionally contains an ultraviolet absorber, such as illustrated by *Research Disclosure* I, Section VI. UV dyes/optical brighteners/luminescent dyes, paragraph (1).

Elements having excellent light sensitivity are best employed in the practice of this invention. Photothermographic elements should have a sensitivity of at least about ISO 1, preferably have a sensitivity of at least about ISO 100, and more preferably have a sensitivity of at least about ISO 400. Elements having a sensitivity of up to ISO 20000 or even higher are specifically contemplated. The speed, or sensitivity, of a photographic element is inversely related to the exposure required to enable the attainment of a specified density above Dmin after processing.

Photographic speed for a reversal black-and-white film element has been specifically defined by the Federal Standard Relative Sensitivity, Method B (Fed. Std. No. 170a, Mar. 31, 1967) and relates specifically the exposure H (in lux-seconds) at the point on the total density versus log exposure curve where the density is 1.00 greater than base plus minimum density. Speed equals 10/H. Photographic speed and the speed class system used to describe radiographic film and film coupled with intensifying elements such as film-intensifying screen systems is discussed by T. S. Curry, J. E. Dowdey, and R. C. Murray, Jr. in *Christensen's Physics of Diagnostic Radiology* $4^{th}$ *edition* (Lea and Febiger, Philadelphia, 1990, chapter 11). The photothermographic element for imaging ionizing radiation should have a speed class greater than 50.

A photothermographic device, comprising photothermographic materials in combination with intensifying means, in accordance with the present invention, can be imagewise exposed to ionizing radiation using contact methods by contacting the surface of the device, a cassette or other assembly containing the photothermographic material to the surface emitting ionizing radiation such as is found in the technique of contact printing of images produced by radioactive isotopes in an electrophoresis gel where a film is placed directly in contact with the electrophoresis gel for a certain amount of time for exposure after which the film is developed. Exposures are monochromatic, orthochromatic, or panchromatic depending upon the spectral sensitization of the photographic silver halide.

The photothermographic elements of the present invention are preferably of type B as disclosed in *Research Disclosure* I. Type B elements contain in reactive association a photosensitive silver halide, a reducing agent or developer, optionally an activator, a coating vehicle or binder, and a salt or complex of an organic compound with silver ion. In these systems, this organic complex is reduced during development to yield silver metal, the organic silver salt is referred to as the silver donor. References describing such imaging elements include, for example, U.S. Pat. Nos. 3,457,075; 4,459,350; 4,264,725; and 4,741,992. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

The photosensitive silver-halide grains and the organic silver salts of the present invention can be coated so that they are in catalytic proximity during development. They can be coated in contiguous layers, but are preferably mixed prior to coating. Conventional mixing techniques are illustrated by *Research Disclosure*, Item 17029 (June 1978), as well as U.S. Pat. No. 3,700,458 and published Japanese patent applications Nos. 32928/75, 13224/74, 17216/75, and 42729/76.

Examples of preferred blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire PO10 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocked developers described in U.S. Pat. Nos. 6,506,546; 6,306,551; 6,426,179; and 6,312,879. Further improvements in blocked developers are disclosed in U.S. Pat. Nos. 6,413,708; 6,543,226; 6,319,640; and 6,537,712. Yet other improvements in blocked developers and their use in photothermographic elements are found in U.S. Pat. Nos. 6,506,528 and 6,472,111.

In one embodiment of the invention blocked developer for use in the present invention may be represented by the following Structure V:

$$\text{DEV—(LINK 1)}_l\text{—(TIME)}_m\text{—(LINK 2)}_n\text{—B} \qquad \text{V}$$

wherein,

DEV is a silver halide color developing agent;

LINK 1 and LINK 2 are linking groups;

TIME is a timing group;

l is 0 or 1;

m is 0, 1, or 2;

n is 0 or 1;

l+n is 1 or 2;

B is a blocking group or B is:

$$\text{—B'—(LINK 2)}_n\text{—(TIME)}_m\text{—(LINK 1)}_l\text{—DEV}$$

wherein B' also blocks a second developing agent DEV.

In a preferred embodiment of the invention, LINK 1 or LINK 2 are of Structure VI:

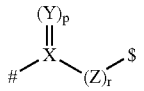

VI wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

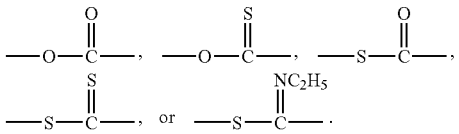

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Other blocked developers that can be used are, for example, those blocked developers disclosed in U.S. Pat. No. 6,303,282 B1 to Naruse et al., U.S. Pat. No. 4,021,240 to Cerquone et al., U.S. Pat. No. 5,746,269 to Ishikawa, U.S. Pat. No. 6,130,022 to Naruse, and U.S. Pat. No. 6,177,227 to Nakagawa, and substituted derivatives of these blocked developers. Although the present invention is not limited to any type of developing agent or blocked developing agent, the following are merely some examples of some photographically useful blocked developers that may be used in the invention to produce developers during heat development.

D-1

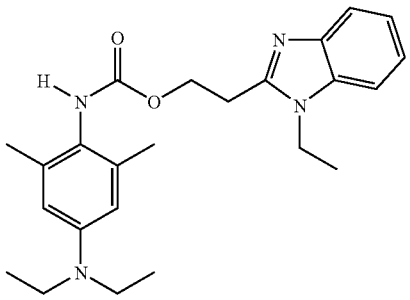

-continued
D-2
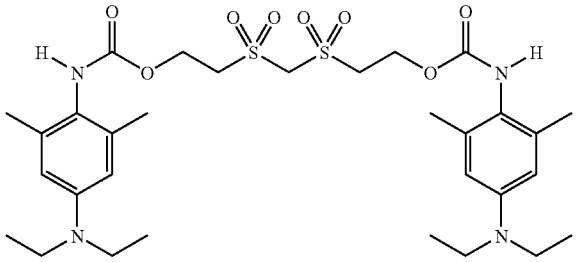
D-3
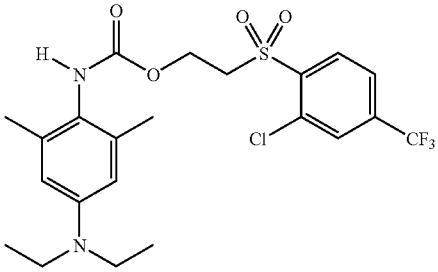
D-4
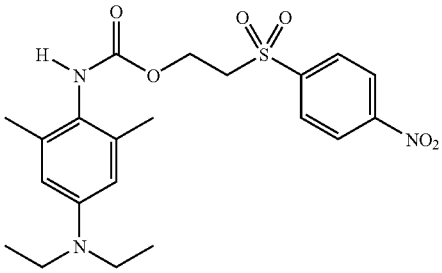
D-5
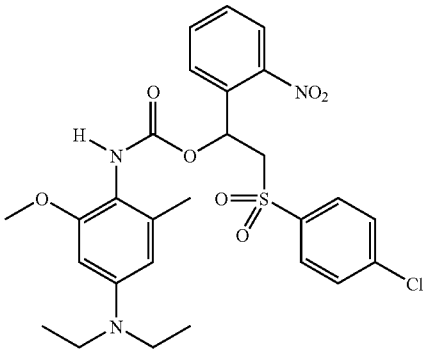
D-6
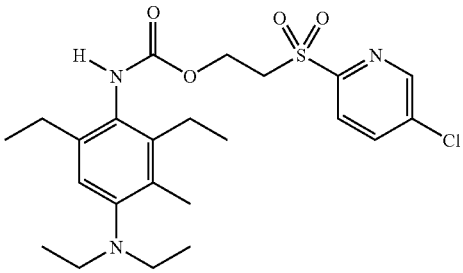
-continued
D-7
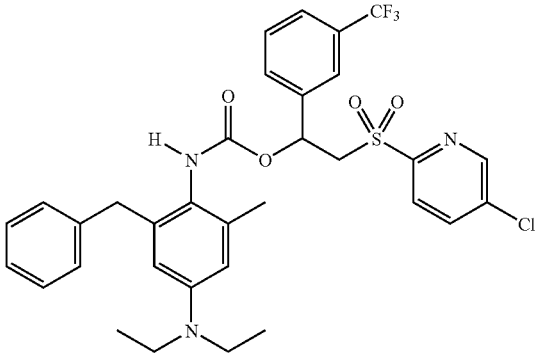
D-8
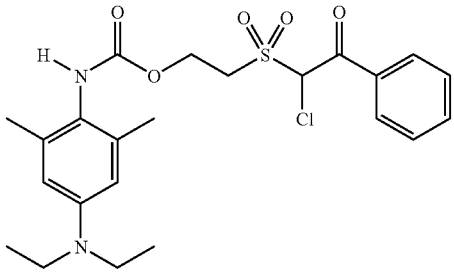
D-9
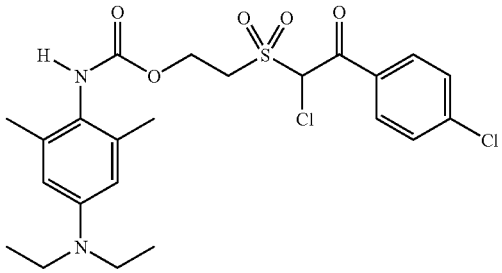
D-10
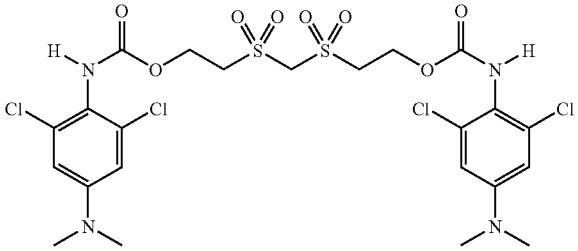
D-11
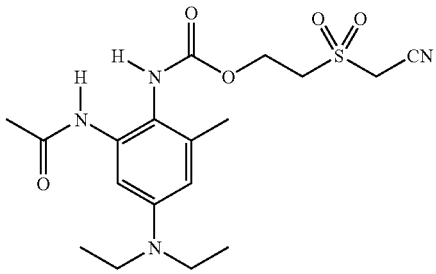

-continued
D-12
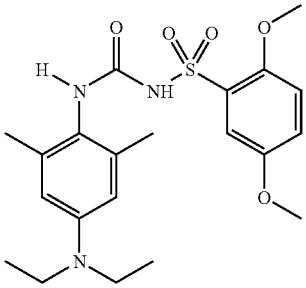
D-13
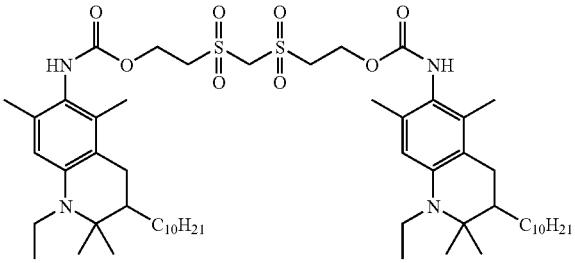
D-14
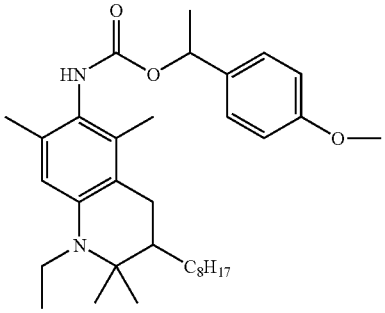
D-15
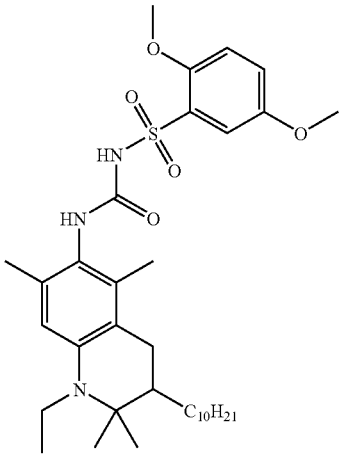
-continued
D-15
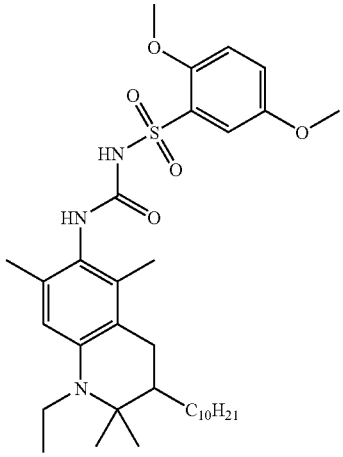
D-16
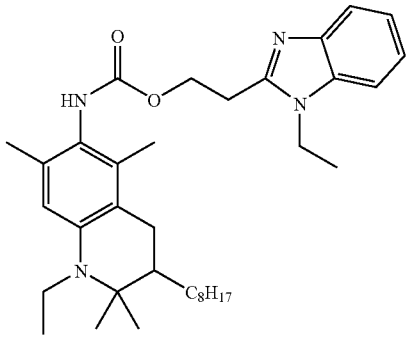
D-17
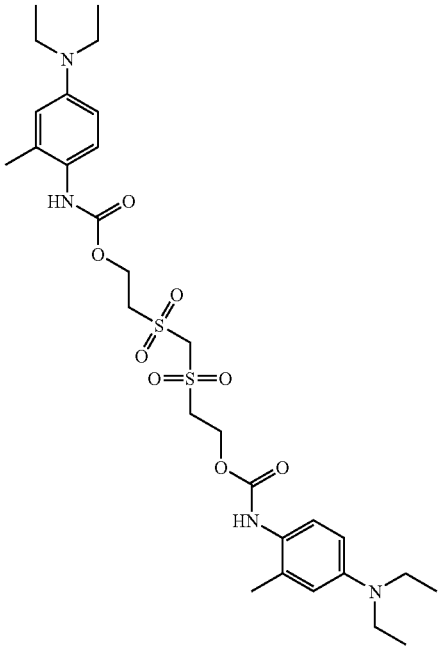

In the preferred embodiment, the blocked developer is preferably incorporated in one or more of the imaging layers of the imaging element. The amount of blocked developer used is preferably 0.01 to 5 g/m$^2$, more preferably 0.1 to 2 g/m$^2$ and most preferably 0.3 to 2 g/m$^2$ in each layer to which it is added. These may be color forming or non-color forming layers of the element.

After imagewise exposure of the imaging element, the blocked developer is activated during processing of the imaging element by the presence of acid or base, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure* I. Such chemicals include, for example, sulfites, hydroxylamine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

A reducing agent in addition to, or instead of, the blocked developer may be included in the photothermographic element. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 1 to 25 percent of the photothermographic layer.

A wide range of reducing agents has been disclosed in dry silver systems including amidoximes such as phenylamidoxime, 2-thienylamidoxime and p-phenoxy-phenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; bis-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzene-sulfon-amido-phenol, and p-benzenesulfonamidophenol; 2-phenylindane-1,3-dione and the like; chromans such as 2,2-dimethyl-7-t-butyl-6 -hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

It is contemplated that the photothermographic element contains a thermal solvent. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Pat. No. 4,123,282.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers t hat function as speed increasing compounds, sensitizing dyes, hardeners, an ti-static agents, plasticizers and lubricants, coating aids, brighteners, ab sorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coate d simultaneously.

A photothermographic element as described preferably comprises a thermal stabilizer to help stabilize the photothermographic element prior to exposure and processing. Such a th ermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis(tribromomethyl)-s-triazines, such as 6-methyl or 6-phenyl-2,4-bis (tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. Heating means known in the photothermographic arts are useful for providing the desired processing temperature for the exposed photothermographic element. The heating means is, for example, a simple hot plate, iron, roller, heated drum, microwave heating means, heated air, vapor or the like. It is contemplated that the design of the processor for the photothermographic element be compatible to the design of the cassette, cartridge, or film packet used for storage and use of the element. Further, data stored on the film or cartridge may be used to modify processing conditions or scanning of the element. Methods for accomplishing these steps in the imaging system are disclosed in commonly assigned, copending U.S. Pat. Nos. 6,062,746 and 6,048,110 which are incorporated herein by reference. The use of an apparatus whereby the processor can be used to write information onto the element, information which can be used to adjust processing, scanning, and image display is also envisaged. This system is disclosed in U.S. Pat. No. 6,278,510 wh ich are incorporated herein by reference.

Thermal processing is preferably carried out under ambient conditions of pressu re and humidity. Conditions outside of normal atmospheric pressure and humidity may be used.

It is contemplated that imaging elements of this invention may be scanned prior to the removal of silver halide from the element. The remaining silver halide yield s a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusin g cavity whose interior walls are specifically designed to produce a high degree of diffuse reflection, and transmissive systems, where diffusion of a beam of specular light is accomplished by the use of an optical element placed in the beam that s erves to scatter light. Such elements can be either glass or plastic that either in corporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The photothermographic materials of the invention can be employed in combination with an intensifying means, for example a photothermographic element in combination with intensifying screen, that is imagewise exposed to ionizing radiation in the form of x-radiation produced by a medical or dental x-ray generator or ionizing radiation produced by an industrial x-ray source such as a Cobalt-60 or Iridium-192. The energy spectrum of the x-radiation is chosen according to the application to be served. In industrial radiography, peak energy levels are often in excess of 150 kV. In medical radiography, peak energy levels rarely exceed 150 kV. Low energy x-radiation exposures for purposes of medical examination are less than 40 kV. Mammography, which is commonly practiced at 28 kV is an example of low energy medical radiography. Dental radiography, commonly practiced at 60 to 90 kV is an example of intermediate energy medical radiography.

As mentioned above, the intensifying means for ionizing radiation converts ionizing radiation into a lower-energy form (for example, lower-energy actinic or non-actinic radiation) that can be used to expose the photothermographic element for the purpose of forming a latent image in the photothermographic receptor layer. In one embodiment, the intensifying means is a phosphor that emits visible light upon exposure to ionizing radiation. Another intensifying means is a metal foil that emits lower energy beta particles upon exposure to ionizing radiation. Another intensifying means is a phosphor screen wherein phosphor particles or amorphous scintillator particles are dispersed in a polymeric binder solution then coated on a support to form a fluorescent layer that can be used to imagewise expose a light sensitive receptor layer upon irradiation with ionizing radiation. Another intensifying means is an x-ray sensitive phosphor layer in combination with a photocathode that emits photoelectrons in response to exposure to ionizing radiation wherein the photoelectrons are accelerated by an external applied field to bombard a second phosphor screen where the visible light emission from the second phosphor screen is used for the purpose of exposing the inventive photothermographic element to form a latent image therein. Accordingly, intensifying means can comprise one or many stages of energy conversion and amplification in any manner which is suitable for the intended application.

A photothermographic assembly can contain a phosphor intensifying means placed in a light-tight package, for example an intra-oral dental film packet, wherein an intensifying element comprises an intensifying screen containing a phosphor that emits light upon exposure to ionizing radiation. In another configuration, the photothermographic element can be placed in a light-tight package containing an intensifying element comprised of a metal foil screen where the function of the metal foil screen is to act both as an intensifying element by absorbing radiation (and releasing lower energy ionizing radiation such as beta particles) and to act as a means of reducing backscatter of radiation that can be detrimental to image quality when the inventive element is imagewise exposed to ionizing radiation. The metal-foil intensifying element can be selected from any metal having an atomic number greater than 3, preferably having an atomic number between 48 and 83. A preferred metal for use in the foil screen has atomic number 50. Another preferred metal for use in the foil screen has atomic number 82. Another preferred metal for use in the foil screen has atomic number 83. The foil can be any thickness suitable for the intended use and ranges from 1 micron to 1 cm in thickness.

Another useful configuration surrounds the inventive photothermographic element (the imaging element) with a liner made of fabric, paper, plastic or other material that will not transmit visible light in a light-tight package optionally containing an outer metal foil in order to minimize the possibility of fogging of the inventive element by inadvertent exposure to visible light. A preferred embodiment, for example, for the use of the inventive element in dental radiography, is to enclose the inventive photothermographic element and at least one phosphor intensifying means, at least one liner, and at least one metal foil in a light tight package, wherein the inventive element and phosphor intensifying element is surrounded with a liner, wherein one face of the liner that is not in contact with the inventive photothermographic element is in contact with a metal foil screen to reduce backscatter of ionizing radiation.

The light-tight package can be made from any material that is suitable for the intended purpose including metals, metallized foils, metallized plastics, plastics, cloth, paper, plastic impregnated paper, inorganic composite materials including ceramics, or extruded resins or plastics of any type. A preferred light-tight package is made from polyethylene resin containing titanium dioxide to impart light opacity to the resin such as is used in intra-oral dental packages.

Sources of ionizing radiation include any means known in the art. Various means for controlling the exposure of ionizing radiation include timers controlling shutters, dose meters controlling shutters, direct control of power to a generator of ionizing radiation like an x-ray tube, and placing or removing the photothermographic element with respect to the source of ionizing radiation. After imagewise exposure to ionizing radiation a photothermographic assembly can be developed according to known methods described in the art.

Organic and inorganic phosphors (and amorphous scintillators) are intensifying means because the light emitted therefrom upon exposure to ionizing radiation is used for the purpose of forming a latent image in the photosensitive photothermographic receptor layer. Phosphor particle intensifying elements used in fluorescent layers such as intensifying screen can have any conventional particle size range and distribution. It is generally appreciated that sharper images are realized with smaller mean particle sizes, but light emission efficiency declines with decreasing particles size. Thus the optimum mean particle size for a given application is a reflection of the balance between imaging speed and image sharpness desired. Conventional phosphor particles size ranges and distributions are illustrated in the phosphor teachings cited below.

Phosphors are materials that emit infrared, visible, or ultraviolet radiation upon excitation. An intrinsic phosphor is a material that is naturally, (that is, intrinsically) phosphorescent. An "activated" phosphor is one composed of a basic material which may or may not be an intrinsic phosphor, to which one or more dopant(s) has been intentionally added. These dopants "activate" the phosphor can cause it to emit infrared, visible, or ultraviolet radiation. For example, in $Gd_2O_2S$:Tb, Ce, the Tb atoms (the emitting center and one of the dopants/activators) give rise to the optical emission of the phosphor. The addition dopant of Ce in the $Gd_2O_2S$ lattice is called a coactivator and improves the overall emission from the Th atoms in the $Gd_2O_2S$:Tb, Ce phosphor. Some phosphors, such as BaFBr:Eu,K,Na, are known as storage phosphors, In these materials the dopants are involved in the storage as well as the emission of radiation.

Any conventional or useful phosphor can be used, singly or in mixtures, in the practice of this invention. More specific details of useful phosphors are provided as follows. For example, useful phosphors are described in numerous references relating to fluorescent intensifying screens including but not limited to *Research Disclosure* Vol 184, August 1979, Item 18431, Section IX, X-ray screens/phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al), U.S. Pat. No. 3,418,246 (Royce), U.S. Pat. No. 3,617,743 (Rabatin), U.S. Pat. No. 3,974,389 (Ferri et al), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al), U.S. Pat. No. 4,387,141 (Patten), U.S. Pat. No. 5,064,729 (Zegarski), U.S. Pat. No. 5,250,366 (Nakajima et al), the disclosures of all of which are incorporated herein by reference with respect to the phosphors.

Useful classes of phosphors include but are not limited to calcium tungstate, ($CaWO_4$), activated or unactived lithium stannates such as $Li_2SnO_3$:Ti, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium activated or unactivated lanthanum and lutetium middle chalcogen phosphors, Still other useful phosphors are those containing hafnium as described for example in U.S. Pat. No. 4,988,880 (Bryan et al), U.S. Pat. No. 4,994,205 (Bryan et al), U.S. Pat. No. 4,988,881 (Bryan et al), U.S. Pat. No. 5,095,218 (Bryan et al), U.S. Pat. No. 5,112,700 (Lambert et al), U.S. Pat. No. 5,124,072 (Dole et al) and U.S. Pat. No. 5,336,893 (Smith et al.) the disclosures of which are all incorporated herein by reference.

Preferred rare earth oxychalcogenide and oxyhalide phosphors are represented by the following formula:

$$M'_{(w-n)}M''_nO_wX'$$

wherein M' is at least one of the metals yttrium (Y), lanthanum (La), gadolinium (Gd), or lutetium (Lu), M" is bismuth (Bi) or at least one of the rare earth metals, preferable dysprosium (Dy), erbium (Er), europium (Eu), holmium (Ho), neodymium (Nd) praseodymium (Pr) samarium (Sm), tantalum (Ta) terbium (Th), thulium (Tm), or ytterbium (Yb), X' is a middle chalcogen. (S,Se,Te) or halogen, N is 0.002 to 0.2, and w is 1 when X' is a halogen or 2 when X' is a middle chalcogen. These include rare earth activated lanthanum oxybromides and terbium activated or thulium activated gadolinium oxy sulfides such as $Gd_2O_2S$:Tb.

Other suitable phosphors are described in U.S. Pat. No. 4,835,397 (Arakawa et al.) and U.S. Pat. No. 5,381,015 (Dooms), both incorporated herein by reference, including for example, divalent europium and other rare earth activated alkaline earth metal halide phosphors and rare earth element activated rare-earth oxyhalide phosphors. Of these types of phosphors, the more preferred phosphors include alkaline earth metal fluorohalide prompt emitting and/or storage phosphors, particularly those containing iodide such as alkaline earth metal fluorobromoiodide storage phosphors as described in U.S. Pat. No. 5,464,568 (Bringley et al.), hereby incorporated herein by reference.

Another class of phosphors are those that include a rare earth host and are rare-earth activated mixed alkaline-earth metal sulfates such as europium-activated barium strontium sulfate.

Particularly useful phosphors are the doped or undoped tantalates such as $YTaO_4$, $YTaO_4$:Nb, Y(Sr)$TaO_4$, Y(Sr)$TaO_4$:Nb, $Mg_4Ta_2O_9$ and $Mg_4Ta_2O_9$:Nb. These phosphors are described in U.S. Pat. No. 4,226,653 (Brixner), U.S. Pat. No. 5,064,729 (Zegarski), U.S. Pat. No. 5,250,366 (Nakajima et al.), U.S. Pat. No. 5,626,957 (Benso et al.) and U.S. Pat. No. 5,132,192 (Sieber et al.) all incorporated herein by reference.

Still other useful phosphors are phosphate-containing phosphors based on the monazite host lattice $LaPO_4$ corresponding to the formula $$La_{(1-x-y)}M'_xM''_yPO_{4-z}F_z$$

wherein M' may be one or a mixture of rare earth metal cation and M" may be one or a mixture of cations selected from Mg, Ca, Sr, Ba; $0<x<1$ and $0<y<0.5$ and $0<z<0.5$. This class of compounds includes the low cost green emitting phosphor $LaPO_4$:Tb,Ce as well as the ultraviolet emitting phosphors $LaPO_4$:Ce and $LaPO_{4-x}F_x$:Ce,Sr.

Other useful phosphors are alkaline-earth metal phosphors that can be the products of firing starting materials comprising optional oxide and a combination of species characterized by the following formula:

$$MFX_{1-z}I_zuM^aX^a:yA:eQ:tD$$

wherein "M" is magnesium (Mg), calcium (Ca), strontium (Sr) or barium (Ba); "F" is fluoride; "X" is chloride (Cl) or bromide (Br); "I" is iodide; $M^a$ is sodium (Na), potassium (K), rubidium (Rb) or cesium (Cs); $X^a$ is fluoride (F), chloride (Cl), bromide (Br) or iodide (I); "A" is europium (Eu), cerium (Ce), samarium (Sm) or terbium (Tb); and "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$, $Nb_2O_5$, $Ta_2O_5$, or $ThO_2$; "D" is vanadium (V), chromium (Cr), manganese (Mn), iron (Fe), cobalt (Co), or nickel (Ni). The numbers in the noted formula are the following: "z" is 0 to 1, "u" is from 0 to 1; "y" is from $1\times10^{-4}$ to 0.1; "e" is from 0 to 1; and "t" is from 0 to 0.01. These definitions apply wherever they are found in this application unless specifically stated to the contrary. It is also contemplated that "M", "X", "A", and "D" represent multiple elements in the groups identified above.

Storage phosphors are also intensifying elements and can also be used in the practice of this invention. Various storage phosphors are described for example in U.S. Pat. No. 5,464,568 (noted above) incorporated herein by reference. Such phosphors include divalent alkaline-earth metal fluorohalide phosphors that may contain iodide and are the product of firing an intermediate, comprising oxide and a combination of species characterized by the following formula:

$$(Ba_{1-a-b-c}Mg_aCa_bSr_c)FX_{1-z}I_{zr}M^aX^a:yA$$

wherein X, $M^a$, $X^a$, A, z and y have the same meanings as for the preceeding formula, and the sum of a, b, and c is from 0 to 1, and r is from $1\times10^{-6}$ to 0.1. Some embodiments of these phosphors are described in more detail in U.S. Pat. No. 5,464,568 (noted above).

Still other storage phosphors are described in U.S. Pat. No. 4,368,390 (Takahashi et al.) incorporated herein by reference and include divalent europium and other rare-earth activated alkaline-earth metal halides and rare-earth element activated rare-earth oxyhalides as described in more detail above.

Still other examples of useful phosphors include SrS:Ce, Sm; SrS:Eu,Sm; $ThO_2$Er; $La_2O_2S$:Eu,Sm; ZnS:Cu,Pb; and others described in U.S. Pat. No. 5,227,253 (Takasu et al.), incorporated herein by reference.

Still another useful class of phosphor intensifying elements for use in the present invention are the activated alkali halide phosphors with monovalent and divalent activator cations. Many alkali halide phosphors are photostimulable storage phosphors as well as efficient thermoluminescent phosphors. Thermoluminscent phosphor intensifying elements are phosphors that store the x-ray energy upon exposure and liberate this energy at a later time in the form of photons upon the application of heat. Examples of a storage phosphor that is also thermoluminscent is CsBr:Eu. The properties of CsBr:Eu as a storage phosphor are well documented in the literature. (For example, see P. Hackenschmeied, G. Schierning, M. Batentschuk, and A. Winnacker in Journal of Applied Physics, 93(9), 5109, (2003)). The properties of CsBr:Eu as an x-ray sensitive thermoluminescent material with thermoluminescent emission temperature at or below the processing temperatures for the inventive photothermographic element described here are described by Y. V. Zorenko, R. M. Turchak, and I. V. Konstankevych in Functional Materials, 10(1), 75, (2003).

The one or more phosphors used in the practice of this invention are present in the present photothermographic materials in an amount of at least 0.01 mole per mole and preferably from about 0.1 to about 20 mole per mole of total silver in the photothermographic material.

It is advantageous to match the emission from the phosphor intensifying means to the spectral sensitivity of the inventive photothermographic element. Matching may involve either the use of appropriately sensitized photothermographic materials or the matching of the emission from the intensifying means to the native sensitivity of the photothermographic materials.

Because of the size of the phosphors used in the invention, generally the layer in which they are incorporated (usually one or more emulsion layers) have a dry coating weight of at least 5 $g/m^2$ and preferably from about 5 $g/m^2$ to about 200 $g/m^2$. In one configuration of the invention the one or more phosphors and the photosensitive silver halide are incorporated within the same imaging layer that has a dry coating weight within the noted preferred range.

In another configuration of the invention, the phosphor is in a separate layer. Phosphors coated in a separate layer on a support are often called x-ray intensifying screens. The support can be any suitable substrate known in the art. For example, a particularly useful support is a polymeric support that is preferably a flexible, transparent or opaque film that has any desired thickness and is composed of one or more polymeric materials. The support is required to exhibit dimensional stability and to have suitable adhesive properties with overlying layers. Useful polymeric materials for making such supports include polyesters (such as polyethylene terephthalate and polyethylene naphthalate), cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

It is also useful to use supports comprising dichroic mirror layers as described in U.S. Pat. No. 5,795,708 (Boutet), incorporated herein by reference.

Also useful are transparent, multilayer, polymeric supports comprising numerous alternating layers of at least two different polymeric materials as described in U.S. Pat. No. 6,630,283 (Simpson et al.), incorporated herein by reference.

Opaque supports can also be used, such as dyed polymeric films and resin-coated papers that are dimensionally stable at room temperature and at high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

The x-ray intensifying screens used in this invention are either separate or integral with the inventive photothermographic element. They can be incorporated in a separate layer coated in a multiplayer photothermographic One configuration of an intensifying means is an intensifying screen which comprises, for example coated on a conventional support, a binder and a phosphor intensifying element. Sufficient binder to give structural coherence to the layer is used. Binders for the phosphor layers of intensifying screen are often selected for their wear resistance since screens are normally reused until physically worn. In addition, the binders employed in the intensifying screens and generally chosen from organic polymers which are transparent to x-radiation and the light emitted from the phosphors. Various polymers used for intensifying screens include sodium o-sulfobenzaldehyde acetal of poly(vinyl alcohol); chlorosulfonated poly(ethylene); a mixture of macromolecular bisphenol poly(carbonates) and copolymers comprising bisphenol carbonates and poly(alkylene oxides); aqueous ethanol soluble nylons; poly(alkyl acrylates and meth-acrylates) and copolymers of alkyl acrylates and methacrylates with acrylic and methacrylic acid; poly(vinyl butyal)s; and poly(urethane) elastomers. These and other useful binders are disclosed in U.S. Pat. Nos. 2,502,529; 2,887,379; 3,617,285; 3,300,310; 3,300,311; and 3,743,833; and in *Research Disclosure* Vol 154, February 1977, Item 15444, and Vol. 182, June 1979. Particularly preferred intensifying screen binders are poly(urethanes) such as those commercially available under the trademark Estane from Goodrich Chemical Co. the trademark Permuthane from the Permuthane Division of ICI, Ltd, and the Trademark Cargill from Cargill, Inc.

Any conventional ratio of phosphor to binder can be employed. Generally thinned fluorescent layer intensifying elements and sharper images are realized when a high weight ratio of phosphor to binder is employed. Typical weight ratios of phosphor to binder are between 5:1 and 50:1 and more preferably 10:1 to 25:1. In those instances in which it is desired to improve the imaging performance of an intensifying screen without changing its thickness, the fluorescent layer is modified to impart a small but significant degree of light absorption within the screen. If the binder is chosen to exhibit the desired degree of light absorption then no other ingredient of the fluorescent layer is required to perform the light attenuation function. For example, a slightly yellow transparent polymer will absorb a significant fraction of phosphor emitted blue light. Ultraviolet absorption can be similarly achieved. It is specifically noted that the less structurally complex chromophores for ultraviolet absorption particularly lend themselves to incorporation in binder polymers.

Where a separate absorber is incorporated in the phosphor layer intensifying element to improve the imaging performance of the layer, the absorber can be a dye or pigment capable of absorbing light within the spectrum emitted by the phosphor. Yellow dye or pigment selectively absorbs blue light emissions and is particularly useful with a blue emitting phosphor. On the other hand, a green emitting phosphor is better used in combination with magenta dyes or pigments. Ultraviolet emitting phosphors can be used with known ultraviolet absorbers. Black dyes and pigments are, of course, generally useful with phosphors because of their broad absorption spectra. Carbon black is a preferred light absorber for incorporation in the fluorescent layers because of its low cost and broad spectrum of absorption. Luckey and Cleare U.S. Pat. No. 4,259,588 here incorporated by reference, teaches that increased sharpness can be achieved by incorporating a yellow dye in a terbium activated gadolinium oxysulfide fluorescent layer.

The fluorescent layer intensifying element can, if desired, be constructed of multiple fluorescent layers comprised of similar or dissimilar phosphors, however, it is preferred that the fluorescent layer unit be constructed of a single fluorescent layer containing a single phosphor.

Another configuration of the present invention involves coating the photothermographic element of the invention directly onto the surface of an intensifying screen intensifying element to form a unitary photothermographic imaging element according to the method described in U.S. Pat. No. 4,865,944, the disclosure of which is here incorporated by reference. In this configuration, the wear-resistant screen binders can be used in the photothermographic element of this invention when employed in combination with subbing layers to achieve adhesion to the film support and novel interlayers to effect adhesion of the fluorescent layer to the hydrophilic colloid binder of the photothermographic emulsion layer. It has been recognized that the types of polymers employed to promote adhesion between gelatino-silver halide emulsion layers and polyester film supports form generally satisfactory fluorescent layer binders. In other words, the preferred binders for the fluorescent layers of the elements of this invention are the same binders employed to form subbing layers on polyester film supports, such as poly(ethylene terephthalate) film supports.

The following examples illustrate the practice of this invention. They are not intended to be exhaustive of all possible variations of the invention. Parts and percentages are by weight unless otherwise indicated.

EXAMPLES

Silver Salt Dispersion SS-1:

A stirred reaction vessel was charged with 480 g of lime processed gelatin and 5.6 l of distilled water. A solution containing 0.7 M silver nitrate was prepared (Solution A). A solution containing 0.7 M benzotriazole and 0.7 M NaOH was prepared (Solution B). The mixture in the reaction vessel was adjusted to a pAg of 7.25 and a pH of 8.00 by additions of Solution B, nitric acid, and sodium hydroxide as needed.

Solution A was added with vigorous mixing to the kettle at 38 cc/minute, and the pAg was maintained at 7.25 by a simultaneous addition of solution B. This process was continued until the quantity of silver nitrate added to the vessel was 3.54 M, at which point the flows were stopped and the mixture was concentrated by ultrafiltration. The resulting silver salt dispersion contained fine particles of silver benzotriazole.

Silver Salt Dispersion SS-2:

A stirred reaction vessel was charged with 480 g of lime processed gelatin and 5.6 l of distilled water. A solution containing 0.7 M silver nitrate was prepared (Solution A). A solution containing 0.7 M 1-phenyl-5-mercaptotetrazole and 0.7 M NaOH was also prepared (Solution B). The mixture in the reaction vessel was adjusted to a pAg of 7.25 and a pH of 8.00 by additions of Solution B, nitric acid, and sodium hydroxide as needed.

Solution A was added to the kettle at 19.6 cc/minute, and the pAg was maintained at 7.25 by a simultaneous addition of solution B. This process was continued until the 3.54 moles of silver nitrate had been added to the vessel, at which point the flows were stopped and mixture was concentrated by ultrafiltration. The resulting silver salt dispersion contained fine particles of the silver salt of 1-phenyl-5-mercaptotetrazole.

Silver Salt Dispersion SS-3:

A silver salt dispersion comprising equal 2:1:1 molar ratio of silver: benzotriazole: 1-phenyl-5-mercaptotetrazole was prepared according to the methods described for the individual silver salts of benzotriazole, and 1-phenyl-5-mercaptotetrazole.

Emulsion E-1:

Emulsion example E-1 is a bromoiodide emulsion containing tabular grains having a mean equivalent circular diameter of 0.3 μm and a mean thickness of 0.12 μm. The overall bulk iodide content was 4.5 mole %.

The emulsion was then chemically and spectrally sensitized to green light using the following spectral sensitizing dyes:

Spectral Sensitizing Dyes:

GSD-1:Anhydro-5-chloro-9 ethyl-5'-phenyl-3'-(3-sulfobutyl)-3-(3-sulfopropyl)-oxacarbo hydroxide, sodium salt.

GSD-5: Anhydro-3,9-diethyl-3'-[N-(methylsulfonyl)carbamoylmethyl]-5-phenylbenzothiazolo oxacarbocyanine hydroxide.

The chemical and spectral finish was in accordance with standard trade practice for color negative film applications. When exposed to light, the silver halide grains form surface latent image that amplifies during solution development to form a silver/dye negative image. C-41 is a typical process.

Preparation of Silver Bromoiodide Emulsion E-2).

Emulsion E-2 is a silver bromoiodide emulsion containing tabular grains having a mean equivalent circular diameter of 0.6 μm. The emulsion was optimally chemically sensitized with sulfur and gold and spectrally pan-sensitized using known methods in the art with sensitizing dyes GSD-2, GSD-3 and GSD-4 in the relative amounts listed in Table 1.

TABLE 1
GSD-2 (0.138 g/mol silver)
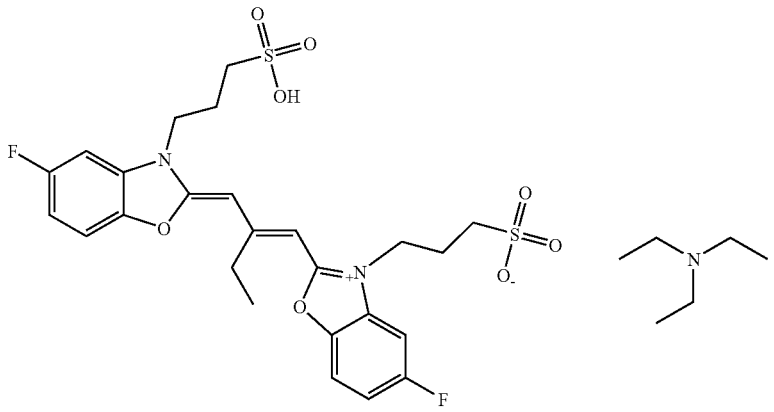
GSD-3 (0.04 g/mol silver)
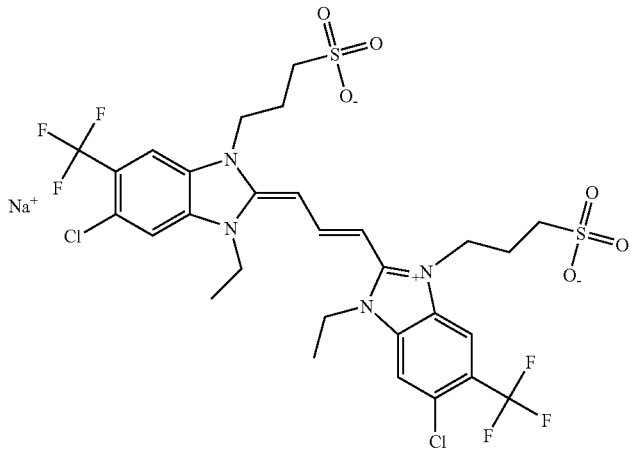
GSD-4 (0.231 g/mol silver)
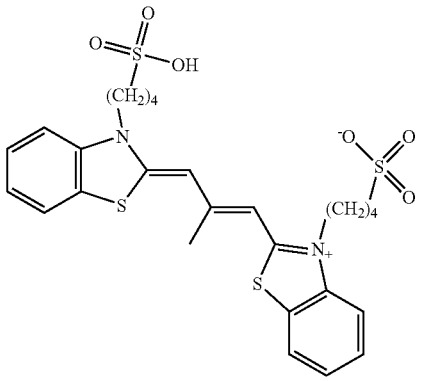

Developer Dispersion, DD-1:

A dispersion of developer D-17 was prepared by the method of ball milling. For each gram of incorporated developer, 0.2 g of sodium tri-isopropylnaphthalene sulfonate, 10 g of water, and 25 ml of beads were added. Following milling, the zirconia beads were removed by filtration. The slurry was refrigerated prior to use.

D-17

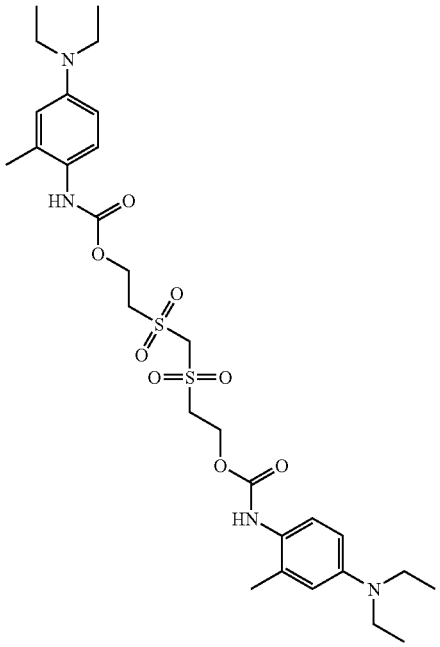

Thermal Solvent Dispersion, TSD-1:

A dispersion of salicylanilide (TS-1) was prepared by the method of ball milling. A total of 19 g of slurry was produced by combining 3.0 gm TS-1 solid, 0.20 g polyvinyl pyrrolidone, 0.20 g TRITON X-200 surfactant, and 15.6 g distilled water. To this mixture was added 20 ml of zirconia beads. The slurry was ball milled for 48 hours. Following milling, the zirconia beads were removed by filtration. At this point, 1 g of gelatin was added, allowed to swell, and then dissolved in the mixture by heating at 40 C. The resulting mixture was chill set to yield a dispersion containing 5% gelatin and 15% TS-1.

Phenolic Coupler Dispersion, PCD-1:

A dispersion of cyan coupler PC-1 was prepared by the method of ball milling. A total of 200 g of slurry was produced by combining 20 g PC-1 solid, 30 g of 10% oleylmethyltaurate, and 150 g distilled water. To this mixture was added 475 ml of 1.8 mm zirconia beads. The slurry was ball milled for 72 hours. Following milling, the zirconia beads were removed by filtration.

PC-1

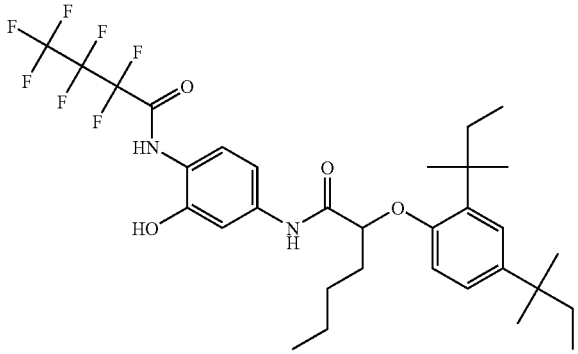

Phenolic Coupler Dispersion, PCD-2:

Phenolic coupler PC-1 (30 g) was dissolved in 60 g ethyl acetate at 60 C. Another solution was prepared by combining 40 g gelatin, 337.5 g water and 32.5 g of 10% 2-Naphthalenesulfonic acid, tris(1-methylethyl)-, sodium salt and heating at 50 C. The solutions were combined and passed through a colloid mill five times. The ethyl acetate was removed by rotary evaporation for 20 minutes.

Phenolic Coupler Dispersion, PCD-3:

A dispersion of phenolic coupler PC-2 was prepared by the method of ball milling. A slurry was produced by combining 20 g PC-2 solid, 20 g of 10% polyvinyl pyrrolidone, and 160.0 g distilled water. To this mixture was added 475 ml of 1.8 mm zirconia beads. The slurry was ball milled for 72 hours. Following milling, the zirconia beads were removed by filtration.

PC-2

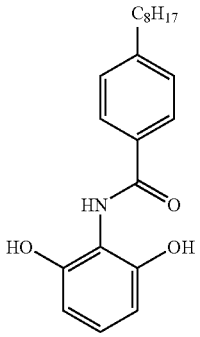

Phenolic Coupler Dispersion, PCD-4:

A dispersion of phenolic coupler PC-3 was prepared by the method of ball milling. A slurry was produced by combining 20 g PC-3 solid, 20 g of 10% polyvinyl pyrrolidone, and 160.0 g distilled water. To this mixture was added 475 ml of 1.8 mm zirconia beads. The slurry was ball milled for 72 hours. Following milling, the zirconia beads were removed by filtration.

PC-3

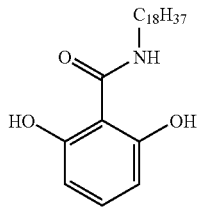

Phenolic Coupler Dispersion PCD-5:

A dispersion of catechol PC-4 was prepared by the method of ball milling. A slurry was produced by combining 20 g PC-4 solid, 17.5 g of 10% polyvinyl pyrrolidone, 2.5 g of 9.14% Pionin A44SP, and 162.5 g distilled water. To this mixture was added 475 ml of 1.8 mm zirconia beads. The slurry was ball milled for 72 hours. Following milling, the zirconia beads were removed by filtration.

PC-4

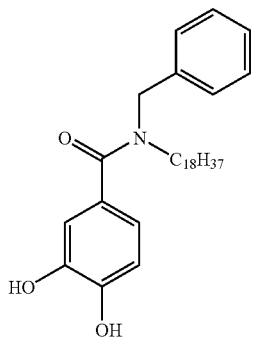

Preparation of Intensifying Screen Intensifying Elements

Handcoatings of intensifying screen intensifying elements for ionizing radiation were prepared by dispersing commercially obtained phosphors in a 12% by weight solution of BUTVAR-79 in cyclohexanone. BUTVAR-79 is obtained from Wacker Chemical. Ultraviolet-emitting cerium activated lanthanum phosphate (type NP-806) phosphor was obtained from Nichia Corporation of America. Red-emitting europium activated gadolinium oxysulfide (type 3011–13) phosphor was obtained from Nichia Corporation of America. Green-emitting terbium activated lanthanum phosphate phosphor (type 2212) was obtained from Osram Sylvania. Blue-emitting europium activated barium strontium sulfate phosphor was obtained from the Health Imaging Division of Eastman Kodak Company. Blue-emitting Xomatic Regular™ intensifying screens containing the europium activated barium strontium sulfate phosphor were obtained from the Health Imaging Division of Eastman Kodak Company. Blue-emitting Hi Plus™ intensifying screens containing the intrinsic blue emitting phosphor calcium tungstate were obtained from E.I. Dupont De Nemours Company. Phosphor dispersions for coating were prepared by adding 3.937 grams of phosphor to 10 mls of 12% BUTVAR-79 in cyclohexanone. The dispersions was rolled for at least 24 hours before coating on an unsubbed 0.018 cm (0.007 inches) thick poly(ethylene terephthalate) support using a blade with a clearance of 0.015 cm (0.006 inch) above the support to give a coating with approximate coating weight of phosphor equal to 60 grams per square meter. The coating was dried in air then further dried for 8 hours at 50 degrees C. Intensifying screens with the phosphors $LaPO_4$:Ce, $Gd_2O_2S$:Eu and $LaPO_4$:Tb,Ce were prepared as described above. The dried screens were then cut to the desired size as appropriate for the examples described below.

Example 1

The following aqueous multilayer coating, in Table 2, was prepared using negative-working emulsion E-2 according to methods known in the art. The support was 0.018 cm (0.007 inch) thick poly(ethylene terephthalate).

TABLE 2

| Component | $g/m^2$ |
|---|---|
| Layer 1: Interlayer | |
| Gelatin | |
| Ethene, 1,1'-(methylenebis(sulfonyl))bis- | 0.14 |
| Layer 2: Imaging Layer | |
| Pan-Sensitive Silver (from emulsion E-2) | .54 |
| Silver (from silver salt SS-1) | 1.08 |
| Silver (from silver salt SS-2) | 1.08 |
| Phenolic Coupler PC-4 (from PCD-5) | 1.08 |
| Developer D-17 (from DD-1) | 1.08 |
| Salicylanilide (from TSD-1) | 2.16 |
| Gelatin | 6.88 |
| Layer 3: Overcoat | |
| Gelatin | 3.23 |
| Surfactant SF-1 | 0.01 |
| Ludox ® AM (colloidal silica) | 0.15 |

Example 2

Example 2 illustrates the sensitivity of coating Example 1 when combined with several phosphor intensifying screens. Coating Example 1 was placed in face-side contact with each screen and the combined film packet was exposed to x-ray radiation with the backside of the intensifying screen facing the x-ray source. The x-ray exposures ranged from 0.09 mRems to 128.8 mRems. Table 3 below lists the peak wavelength emitted by each screen, Table 4 shows the x-ray source settings for each exposure level, and Table 5 lists, for each exposure level, the developed blue transmission density after thermally processing coating Example 1 at 162° C. for 30 sec. FIG. 1 shows the H & D photographic curve (developed blue transmission density vs relative log exposure level) which has a decreasing slope indicating a positive response (decreasing density with increasing exposure).

TABLE 3

| | Phosphor ID | | | | |
|---|---|---|---|---|---|
| | 1 | 2 | 3 | 4 | 5 |
| Description | $LaPO_4$:Ce | XOMATIC REG | Dupont HI PLUS | $LaPO_4$: Ce, Tb | $Gd_2O_2S$: Eu |
| Coverage | 60 g/m^2 | | | 60 g/m^2 | 60 g/m^2 |
| Commercial Source | Nichia NP-806 | | | Osram 2212 | Nichia 3011–13 |
| peak emission (nm) | 318 | 390 | 450 | 544 | 626 |

TABLE 4

| Relative exposure | Theor. mRems | Measured mRems | mA | mSec | KVp | Distance (cm) | mAs | log(E) | mirror | Cu* (mm) | Al (mm) | LUCITE (cm) |
|---|---|---|---|---|---|---|---|---|---|---|---|---|
| 0.5 | 1 | 0.09 | 100 | 50 | 57 | 177.8 | 5 | −1.045757 | no | 0.5 | 1 | 5.08 |
| 1 | 2 | 1.02 | 200 | 200 | 60 | 177.8 | 40 | 0.0086 | no | 0.5 | 1 | 5.08 |
| 4 | 8 | 4.01 | 510 | 300 | 60 | 177.8 | 153 | 0.603144 | no | 0.5 | 1 | 5.08 |
| 16 | 32 | 15.98 | 570 | 300 | 60 | 97.8 | 171 | 1.203577 | no | 0.5 | 1 | 5.08 |
| 32 | 64 | 31.9 | 570 | 600 | 60 | 97.8 | 342 | 1.503791 | no | 0.5 | 1 | 5.08 |
| 64 | 128 | 63.9 | 570 | 1200 | 60 | 97.8 | 684 | 1.805501 | no | 0.5 | 1 | 5.08 |
| 128 | 256 | 128.8 | 110 | 140 | 60 | 97.8 | 15.4 | 2.109916 | no | 0 | 0 | 0 |

TABLE 5

| Measured | | Blue density by Phosphor ID | | | | |
|---|---|---|---|---|---|---|
| MRems | log(E) | 1 | 2 | 3 | 4 | 5 |
| 0.09 | −1.05 | 3.78 | 3.627 | 3.611 | 3.603 | 3.576 |
| 1.02 | 0.01 | 3.46 | 3.312 | 3.352 | 3.457 | 3.286 |
| 4.01 | 0.60 | 3.498 | 2.009 | 1.924 | 3.406 | 3.376 |
| 15.98 | 1.20 | 3.593 | 0.68 | 0.676 | 3.386 | 3.287 |
| 31.9 | 1.50 | 3.422 | 0.657 | 0.659 | 3.139 | 2.959 |
| 63.9 | 1.81 | 3.331 | 0.688 | 0.681 | 2.555 | 2.22 |
| 128.8 | 2.11 | 3.106 | 0.694 | 0.7 | 1.774 | 0.98 |

The above results show that phosphor screens 2 and 3 produced the fastest photographic response in combination with coating Example 1, because of the relatively higher phosphor coverage of these commercial phosphor screens (intensifying elements). The exposure necessary to achieve a minimum blue density is approximately 16 mRem (corresponding to 1.20 relative log exposure in FIG. 1). The unexposed areas of coating Example 1 thermally developed to a blue transmission density exceeding 3.5.

Example 3

The following aqueous single layer coating shown in Table 6 was prepared using negative working emulsion E-1 and silver salt SS-3. The support was 0.018 cm (0.007 inch) thick poly(ethylene terephthalate).

TABLE 6

| Component | $g/m^2$ |
|---|---|
| Layer 1: Imaging Layer | |
| Green Sensitive Silver (from emulsion E-1) | 0.46 |
| Silver (from silver salt SS-3) | 0.46 |
| Phenolic Coupler PC-4 (from PCD-3) | 1.12 |

TABLE 6-continued

| Component | $g/m^2$ |
|---|---|
| Developer D-17 (from DD-1) | 0.34 |
| Salicylanilide (from TSD-1) | 0.86 |
| Gelatin | 3.77 |

Example 4

Single layer coating Examples 4 incorporates a $BaSO_4$.Sr,Eu phosphor directly in the photothermographic element. The preparation follows coating Example 3 except for the addition of blue light emitting phosphor $BaSO_4$.Sr,Eu (emits at 390 nm and is the same phosphor in XOMATIC REG screens), added as a solid powder to the coating melt. The coverage of $BaSO_4$.Sr,Eu was 0.65 $g/m^2$.

Example 5

Single layer coating Examples 5 is identical to Example 4 except the coverage of $BaSO_4$.Sr,Eu was 1.30 $\mu g/m^2$.

Example 6

Example 6 demonstrates the sensitivity of coating Examples 4–5 to x-ray exposure. For comparison, a sample of coating Example 3 was also combined with an external green light emitting screen ($LaPO_4$:Ce,Th at 60 $g/m^2$, emitting at 544 nm); another sample was combined with an external blue light emitting screen ($BaSO_4$.Sr,Eu at 60 $g/m^2$, emitting at 394 nm). Coating Example 3 was placed in face side contact with each screen and the combined packet was exposed with the backside of the screen facing the x-ray source. Samples of coating Example 4 and 5 were exposed directly without a screen. The x-ray exposures ranged from 1.02 mRems to 302 mRems. Table 7 below lists the source settings for each exposure level, and Table 8 shows the developed blue transmission density after processing each sample strip at 162° C. for 30 sec.

TABLE 7

| Relative exposure | Measured mRems | mA | mSec | kVp | Distance (cm) | mAs | log(E) | mirror | Cu* (mm) | Al (mm) | LUCITE (cm) |
|---|---|---|---|---|---|---|---|---|---|---|---|
| 1 | 0.92 | 200 | 200 | 60 | 177.8 | 40 | −0.04 | no | 0.5 | 1 | 5.08 |
| 4 | 3.63 | 510 | 300 | 60 | 177.8 | 153 | 0.56 | no | 0.5 | 1 | 5.08 |
| 16 | 14.17 | 570 | 300 | 60 | 97.8 | 171 | 1.15 | no | 0.5 | 1 | 5.08 |
| 32 | 28.2 | 570 | 600 | 60 | 97.8 | 342 | 1.45 | no | 0.5 | 1 | 5.08 |
| 64 | 56.5 | 570 | 1200 | 60 | 97.8 | 684 | 1.75 | no | 0.5 | 1 | 5.08 |
| 128 | 125.1 | 110 | 140 | 60 | 97.8 | 15.4 | 2.10 | no | 0 | 0 | 0 |
| 300 | 301 | 650 | 370 | 60 | 97.8 | 240.5 | 2.48 | no | 0 | 0 | 0 |

TABLE 8

| | Coating | Example 3 | Example 4 | Example 5 | Example 3 |
|---|---|---|---|---|---|
| | Internal Phosphor (blue) | None | $BaSO_4$.Sr, Eu 0.65 g/m$^2$ | $BaSO_4$.Sr, Eu 1.30 g/m$^2$ | None |
| | External Phosphor Screen | Blue (394 nm) (XOMATIC) | none | none | (Green 544 nm) $LaPO_4$: Ce, Tb 60 g/m$^2$ |
| Measured mRems | log(E) | Blue Transmission Density | | | |
| 0.92 | −0.04 | 1.066 | 1.076 | 1.149 | 1.540 |
| 3.63 | 0.56 | 1.104 | 1.075 | 1.234 | 1.536 |
| 14.17 | 1.15 | 1.022 | 1.099 | 1.224 | 1.442 |
| 28.2 | 1.45 | 1.098 | 1.032 | 1.214 | 1.295 |
| 56.5 | 1.75 | 0.970 | 1.059 | 1.204 | 1.320 |
| 125.1 | 2.10 | 0.860 | 1.033 | 1.124 | 0.840 |
| 301 | 2.48 | 0.855 | 0.605 | 0.520 | 0.822 |
| | Delta Density | 0.209 | 0.478 | 0.682 | 0.684 |

Delta density = (density at 0.92 mRem − density at 301 mRem)

The delta densities indicate that an embedded phosphor in the photothermgraphic element provides an effective recording medium for direct x-ray exposures and is dependent on phosphor coverage.

Example 7

Example 7 illustrates the use of coating Example 1 for making dental exposures and a digital process for making prints. Coating Example 1 was combined in face side contact with a blue emitting phosphor screen (DUPONT PAR AA 507026F). The backside of the screen faced the x-ray source. A cadaver dental object was placed on top of the film packet, and the object and was given a 50 mRem exposure. Coating Example 1 was processed at 162° C. for 24 sec to produce a positive image of the teeth in the target. The positive image in the film was digitally scanned into Adobe Photoshop, then grayscaled, contrast adjusted, and finally saved as both negative and positive image files. Both negative and positive image files were diagnostically useful images. Obtaining a positive image was advantageous because certain pathologies are more visible than in the corresponding negative image.

The invention has been described in detail with particular reference to preferred embodiments, but it will be understood that variations and modifications can be effected within the spirit and scope of the invention.

The invention claimed is:

1. A method of forming a positive image in a photothermographic assembly comprising a photothermographic material and an intensifying means for converting ionizing radiation, wherein the assembly has been imagewise exposed to ionizing radiation to form a latent image in the photothermographic material, which photothermographic material has at least one imaging layer comprising a potentially negative-working emulsion, said method further comprising thermally developing the imagewise exposed assembly wherein thermal development of unexposed silver salts in exposed areas is effectively inhibited relative to unexposed areas, thereby producing a positive image and wherein negative image development is inhibited, wherein the imaging layer comprises at least two organic silver salts, a first and a second organic silver salt, wherein the second organic silver salt releases a density-inhibiting agent and has pKsp that is at least 0.5 greater than the pKsp of said first organic silver salt, and wherein the imaging layer further comprises an amine developer or precursor thereof and an oxidized developer scavenging agent to accelerate development by removing oxidized developer as it is formed during the thermal development, which developer scavenging agent is a phenolic coupler.

2. The method of claim 1 wherein the intensifying means and photothermographic material comprise separate elements in the assembly.

3. The method of claim 1 which method comprises imagewise exposing the photothermographic material with a non-solarizing amount of radiation or energy to form a latent image and completely developing the latent image to a positive image in a single thermal development unit step to produce a positive image in the photothermographic material.

4. The method of claim 1, wherein the photothermographic material forms a positive image at high speed when exposed and heated 10 to 40 sec at 150 to 200° C., wherein the ISO speed is at least ISO 100 and as high as ISO 24000.

5. The method of claim 1 wherein the thermal development of unexposed silver salts in the exposed areas is inhibited relative to the unexposed areas by a density inhibiting agent.

6. The method of claim 5 wherein the density-inhibiting agent is released by a precursor compound during the thermal development.

7. The method of claim 1 wherein the photothermographic material comprises a silver-halide emulsion, in which silver-halide grains are spectrally sensitized to light wavelengths in a range 350 nm to 1500 nm, said method comprising, following thermal development of the imagewise exposed material, forming imagewise reduced silver that is physically separate and morphologically distinct from a developed latent-image silver associated with the silver-halide grains.

8. The method of claim 1 comprising, following the thermal development, the following steps:

scanning the developed positive image to form an analog electronic representation of the developed image;

digitizing an analog electronic representation to form a digital image;

digitally modifying the digital image; and storing, transmitting, printing, or displaying the modified digital image.

9. The method of claim 1, wherein the photothermographic material is a high speed black-and-white film.

10. The method of claim 1 wherein the potentially negative-working emulsion comprises primarily tabular grains.

11. The method of claim 1, wherein the photothermographic material comprises at least one light-sensitive imaging layer comprising a potentially negative-working emulsion that comprises light-sensitive silver halide, one or more non-light-sensitive organic silver salts, and wherein the photothermographic material is thermally developed without any externally applied developing agent by heating the photothermographic material in a thermal processor to a temperature greater than 150° C. in an essentially dry process to form a positive image in the photothermographic imaging layer, said method further comprising scanning the positive image to provide a digital electronic record capable of generating a positive or a negative image in a display element.

12. The method of claim 1 wherein the intensifying means is a phosphor that emits visible light upon exposure to ionizing radiation.

13. The method of claim 1 wherein the intensifying means is a metal foil that emits lower energy beta particles upon exposure to ionizing radiation.

14. The method of claim 1 wherein the intensifying means is a phosphor screen wherein phosphor particles or amorphous scintillator particles are dispersed in a polymeric binder solution then coated on a support to form a fluorescent layer that upon irradiation with ionizing radiation can be used to imagewise expose the at least one imaging layer.

15. The method of claim 1 wherein the intensifying means is an x-ray sensitive phosphor layer in combination with a photocathode that emits photoelectrons in response to exposure to ionizing radiation wherein the photoelectrons are accelerated by an external applied field to bombard a second phosphor screen where the visible light emission from the second phosphor screen is used for the purpose of exposing the photothermographic material to form a latent image therein.

16. The method of claim 1 wherein the intensifying means is dispersed in the potentially negative-working emulsion.

17. The method of claim 1 wherein the photothermographic assembly is placed in a light-tight package.

18. The method of claim 17 wherein the photothermographic assembly is an intra-oral dental film packet.

19. The method of claim 17 wherein the light-tight package comprises a liner made of a material that will not transmit visible light in a light-tight package.

20. The method of claim 1 wherein the second organic silver salt that releases a density-inhibiting agent comprises a mercapto-functional compound and the first organic silver salt comprises a salt of a benzotriazole-functional compound.

* * * * *